US005386677A

United States Patent [19]

Kobuki et al.

[11] Patent Number: 5,386,677

[45] Date of Patent: Feb. 7, 1995

[54] GOODS ARRANGEMENT METHOD AND APPARATUS

[75] Inventors: Manabu Kobuki; Teruaki Miyamoto; Kenshi Watari, all of Kasuya, Japan

[73] Assignees: Seibu Electric & Machinery Co., Ltd.; Japan Tabacco Inc.; JT Engineering Inc., Japan

[21] Appl. No.: 39,300

[22] PCT Filed: Apr. 22, 1993

[86] PCT No.: PCT/JP92/01063

§ 371 Date: Apr. 22, 1993

§ 102(e) Date: Apr. 22, 1993

[87] PCT Pub. No.: WO93/03963

PCT Pub. Date: Mar. 4, 1993

[30] Foreign Application Priority Data

Aug. 23, 1991 [JP] Japan ..... 3-237085
Aug. 23, 1991 [JP] Japan ..... 3-237086

[51] Int. Cl.[6] ..... B65B 5/10; B65B 35/24; B65B 69/00; B65G 1/08

[52] U.S. Cl. ..... 53/251; 53/250; 53/443; 53/540

[58] Field of Search ..... 53/447, 443, 540, 543, 53/534, 531, 251, 250, 249

[56] References Cited

U.S. PATENT DOCUMENTS 2,672,289 3/1954 Skillman ..... 235/92
3,247,929 4/1966 Langley ..... 186/1
3,939,621 2/1976 Giori ..... 53/447 X
4,527,937 7/1985 Tomasello, Jr. ..... 414/273
4,628,665 12/1986 Herrington ..... 53/250 X
4,955,175 9/1990 Herrington ..... 53/250 X
4,982,553 1/1991 Itoh ..... 53/251 X
5,083,411 1/1992 Axmann ..... 53/251 X

FOREIGN PATENT DOCUMENTS 3524344 1/1987 Germany .
49-9077 3/1974 Japan .
51-32035 9/1976 Japan .
55-116518A 9/1980 Japan .
55-134901U 9/1980 Japan .
WO87/02016 4/1987 WIPO .

*Primary Examiner*—James F. Coan
*Attorney, Agent, or Firm*—Finnegan, Henderson, Farabow, Garrett & Dunner

[57] ABSTRACT

A goods arrangement system includes a goods storage arrangement apparatus 7000 capable of storing goods temporarily and discharging a specified number of goods at the same time. The goods storage arrangement apparatus 7000 consists of a gradient storage shelf 7774 made up of multiple gravity roller conveyors 7001, and arrangement conveyors 7002 associated with the stories of gravity roller conveyors. Unpackers 1000 and 2000 peel off outer flaps from each box (container) containing goods, and a flap opener 4000 opens up and down outer flaps on one of the sides of a box. A goods takeout apparatus 5000 takes out goods from a box. The taken-out goods are fed to the goods storage arrangement apparatus 7000 by a goods feeder 6000 based on a running cart 6034. In the goods storage arrangement apparatus 7000, the arrangement conveyors 6002 arrange multiple goods in a row substantially perpendicularly to the direction in which the arrangement conveyors run. A goods input apparatus 8000 puts the row of goods in an arrangement container C.

14 Claims, 26 Drawing Sheets

Fig.24

| | | | |
|---|---|---|---|
| Ga | Ga | Ga | Ga |
| Ga | Ga | Ga | Ga |
| Ga | Ga | Ga | Ga |
| Ga | Ga | Ga | Ga |
| Ga | Ga | Ga | Ga |

C

Fig.25

| | | | |
|---|---|---|---|
| Gp | Gk | Gf | Ga |
| Gq | Gl | Gg | Gb |
| Gr | Gm | Gh | Gc |
| Gs | Gn | Gi | Gd |
| Gt | Go | Gj | Ge |

C

Fig.26A

| | | | |
|---|---|---|---|
| Gr | Gr | Gg | Ga |
| Gs | Gr | Gh | Gd |
| Gt | Gr | Gj | Gd |
| Gt | Gr | Gj | Gf |
| Gy | Gr | Gl | Gg |

C

Fig.26B

| | | | |
|---|---|---|---|
| Gs | Gl | Ge | Ga |
| Gt | Gm | Gg | Ga |
| Gg | Gp | Gh | Gb |
| Gz | Gr | Gk | Gd |
| Gz | Gs | Gk | Ge |

C

GOODS ARRANGEMENT METHOD AND APPARATUS

TECHNICAL FIELD

The present invention relates to a goods arrangement method and system in which multiple goods, for example, packs of cigarettes are fetched from a container such as a carton box, temporarily stored in a goods storage arrangement apparatus, discharged in an intended number from the goods storage arrangement apparatus while being arranged, and placed in a container which is different from the carton box.

BACKGROUND ART

A goods arrangement method and system, in which a storage arrangement apparatus is included to temporarily store goods and discharge them while arranging them, has already become popular. The method and system are described in, for example, Japanese Examined Patent Publication (Kokoku) No. 51-32035. This prior art includes a gradient storage shelf made up of gravity roller conveyors that are arranged in the form of a matrix of multiple stories and multiple columns. Goods are fed through an inlet located at a higher end of each gravity roller conveyor, running autonomously toward an outlet at a lower end thereof, and then stored sequentially on the gravity roller conveyor. For four-storied gravity roller conveyors, four carrier conveyors are installed up and down. On each story, a single carrier conveyor runs through outlets of all gravity roller conveyors on the story. The ends of the four carrier conveyors merge into a single merge conveyor, wherein the first carrier conveyor merges into the merge conveyor at the first position, the second carrier conveyor merges into the merge conveyor at the second position that is separated by a specified distance from the first position in the direction in which the merge conveyor carries goods, and the third and fourth carrier conveyors merge into the merge conveyor with a specified distance between them in the direction in which the merge conveyor carries goods. Goods are therefore carried in a row in the direction in which the merge conveyor carries goods. In this prior art, the carrier conveyors and merge conveyor are controlled in speed so that goods carried by, for example, the first and second carrier conveyors will not collide with one another.

In the foregoing prior art, goods are carried in a row in the direction in which the merge conveyor carries goods. Compared with a system in which goods are supplied in rows in the direction in which the merge conveyor carries goods, the aforesaid system is slow in handling goods.

Furthermore, in the prior art, goods cannot be carried simultaneously by four carrier conveyors. This further reduces the goods handling speed of the system.

The prior art has not disclosed relevant equipment used before and after the storage arrangement apparatus.

SUMMARY OF THE INVENTION

An object of the present invention is to solve the aforesaid problems and to provide a goods arrangement method and system capable of arranging goods quickly and efficiently.

A goods arrangement method according to the present invention comprises a step of taking out multiple goods from a container, a step of storing the taken-out goods in a goods storage, a step of simultaneously discharging a specified number of goods from the goods storage onto multiple arrangement conveyors running in a specified direction and of arranging multiple goods on the arrangement conveyors so that the goods will line up substantially perpendicularly to the direction in which the arrangement conveyors run, and a step of putting the row of goods carried by the arrangement conveyors simultaneously in an arrangement container.

A goods arrangement method according to the present invention comprises a step of taking out multiple goods from a container, a step of storing the taken-out goods in a goods storage, a step of simultaneously discharging a specified number of goods from the goods storage onto multiple arrangement conveyors running in a specified direction and of arranging multiple goods on the arrangement conveyors so that the goods will line up substantially perpendicularly to the direction in which the arrangement conveyors run, and a step of putting the row of goods carried by the arrangement conveyors simultaneously in an arrangement conveyor.

According to the foregoing configuration, an article storage arrangement system can discharge goods simultaneously onto multiple arrangement conveyors, and put the row of goods simultaneously in an arrangement container. The present invention thus permits the handling of goods at a considerably higher speed than the aforesaid prior art in which goods are handled in a row.

A goods arrangement system according to the present invention comprises a goods takeout apparatus for taking up multiple goods from a container, a goods storage arrangement apparatus capable of temporarily storing the taken-out goods and discharging a specified number of goods at the same time, a goods feeder for feeding the goods taken out by the goods takeout apparatus to the goods storage apparatus, and a goods input apparatus for putting the goods arranged and discharged by the goods storage arrangement apparatus in an arrangement container.

The foregoing configuration provides an efficient system that has the aforesaid advantages of a method according to the present invention and that can include relevant equipment used before or after the goods storage arrangement apparatus.

Preferably, a gradient storage shelf comprises multiple gravity roller conveyors inclined in a specified direction. The gravity roller conveyors are arranged in the form of a matrix of multiple stories and multiple columns. The number of arrangement conveyors is the same as the number of stories of the storied gravity roller conveyors. Each of the arrangement conveyors is linked with the gravity roller conveyors on all columns on each story.

Preferably, an unpacker is installed to peel off the outer flaps of a box serving as a container from the inner flaps thereof, and a flap opener is also installed to open the outer flaps of a box.

Preferably, the goods feeder is based on a running unit capable of moving along a warehousing frontage made up of multiple lined inlets of the goods storage arrangement apparatus. The running unit has a warehousing device for feeding goods to the inlets of the goods storage arrangement apparatus. The running unit is a running cart, and the warehousing device is mounted on the running cart so as to ascend and descend freely.

BRIEF DESCRIPTION OF THE DRAWINGS

An embodiment of the present invention will be described with reference to the appended drawings in which:

FIG. 24 shows a first example of an arrangement container containing goods;

FIG. 25 shows a second example of an arrangement container containing goods;

FIGS. 26A and 26B show a third example of an arrangement container containing goods.

DESCRIPTION OF THE PREFERRED EMBODIMENTS

Figure 1:
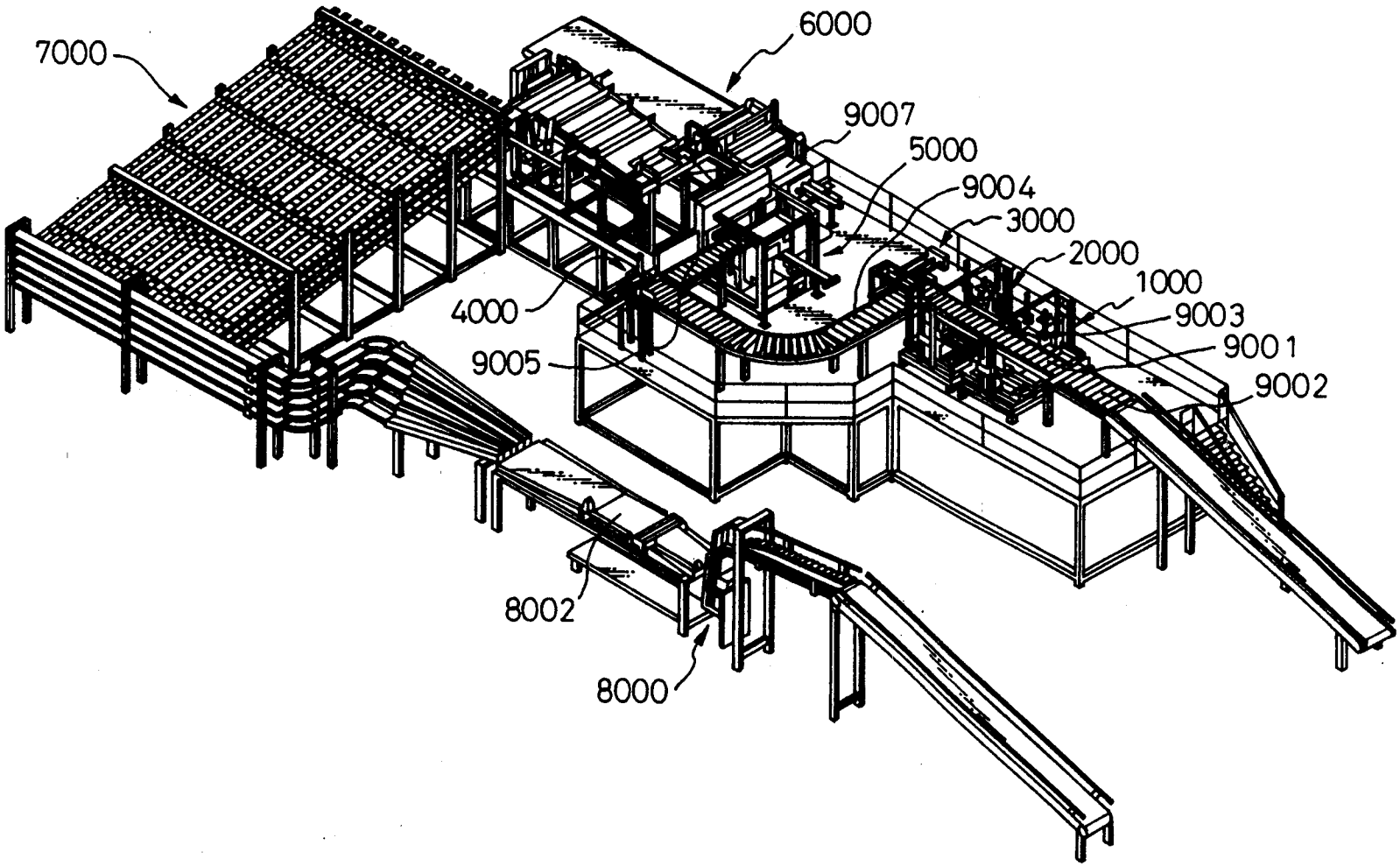
FIG. 1 is an oblique view showing a goods arrangement system according to an embodiment of the present invention.

FIG. 1 shows a goods arrangement system according to an embodiment of the present invention. The goods arrangement system comprises an unpacker 1000 for peeling off upper outer flaps on both sides of a carton box serving as a container for storing goods, an unpacker 2000 for peeling off lower outer flaps on both sides of the carton box, and a pusher 3000 for changing the orientation of the carton box whose upper and lower outer flaps have been peeled off.

Figure 4A:
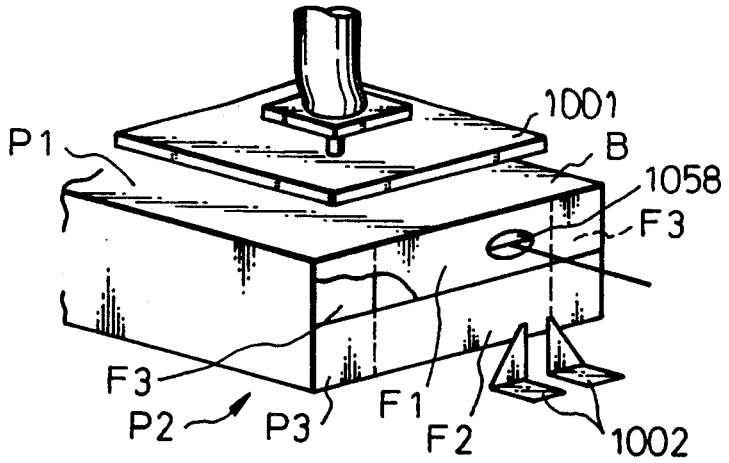
FIGS. 4A to 4C are oblique views for explaining an unpacking procedure for a box containing goods.

As shown in FIG. 4A, in this embodiment, a box B includes a top P1, a bottom P2, and opposed sides P3. Each of the sides P3 has two inner flaps F3 extending vertically, and an upper outer flap F1 and a lower outer flap F2 extending horizontally. After goods are stored in the box B, the inner flaps F3 are closed, and then the upper and lower outer flaps F1 and F2 are folded to overlap the inner flaps F3 and attached to each other. When unpacking the box B, the upper outer flap F1 is peeled off from the inner flaps F3, and then the lower outer flap F2 is peeled off from the inner flaps F3. The box B is carried to the pusher 3000 by a roller conveyor 9001 passing through the unpackers 1000 and 2000. A stopper 9001 is installed at the position on the roller conveyor 9001 corresponding to the front of the unpacker 1000. A stopper 9002 is installed at the position corresponding to the back of the unpacker 1000. Roller conveyors 9004 and 9005 are installed to succeed the pusher 3000 and to take over the roller conveyor 9001.

As shown in FIG. 1, the goods arrangement system further comprises a flap opener 4000 for opening the upper and lower outer flaps F1 and F2 of one of the sides P3 of the box B, a goods takeout apparatus 5000 for taking out goods from the box B by inserting a pusher 5004 (FIG. 11) horizontally into the opened side P3 of the box B, a goods feeder 6000 for feeding the goods taken out from the box B to a goods storage arrangement apparatus 7000, and a goods input apparatus 8000 for putting the goods fed by the goods storage arrangement apparatus 7000 into a moving arrangement container.

Figure 15:
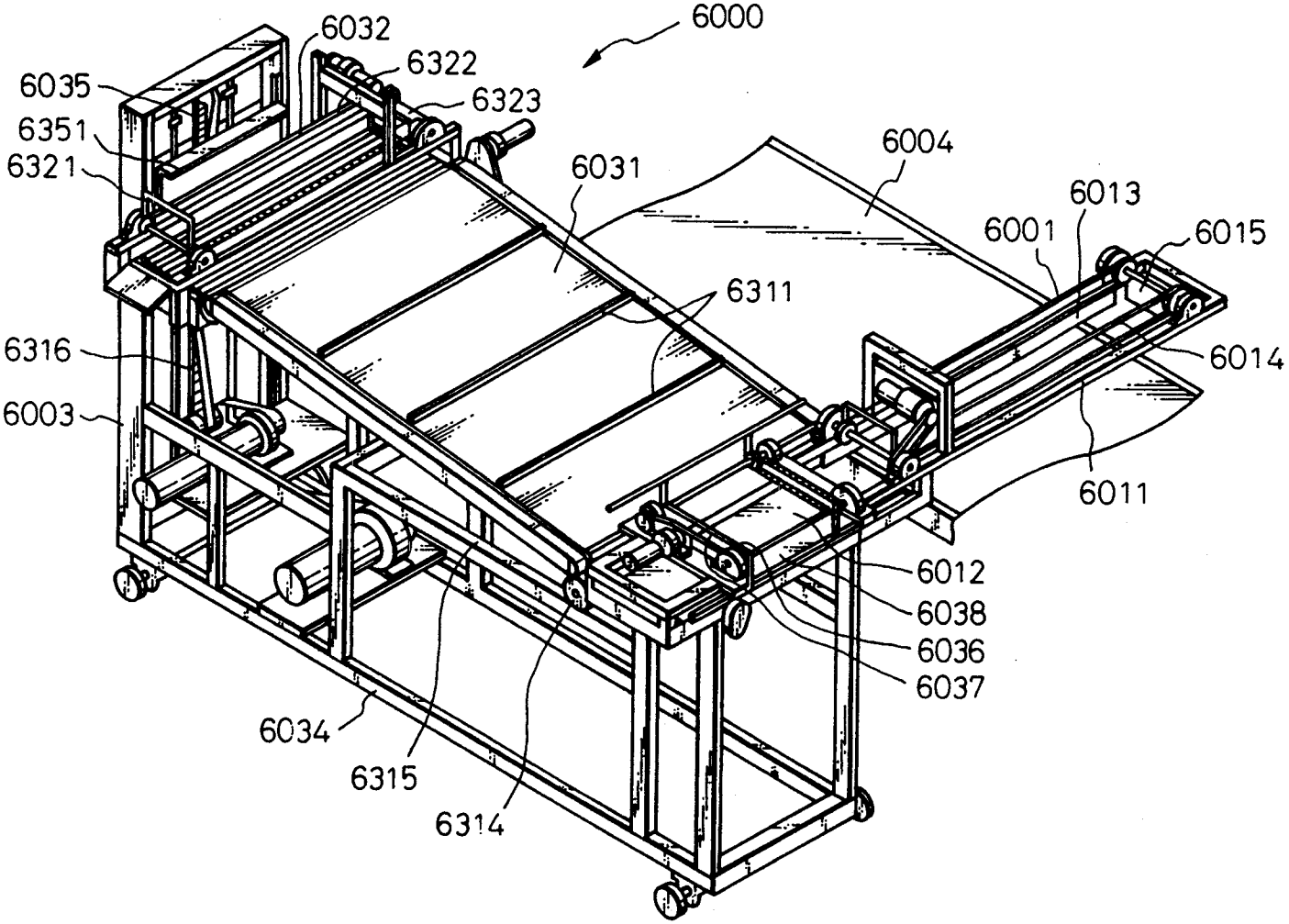
FIG. 15 is a partly enlarged oblique view showing the goods feeder in FIG. 1 and excluding pendulous members.

The goods feeder 6000 includes a running cart 6034 shown in FIG. 15 and a swing conveyor 6031 mounted on the running cart 6034. The running cart 6034 can run along the warehousing frontage of the goods storage arrangement apparatus 7000. The goods storage arrangement apparatus 7000 has a gradient storage shelf 7004 (FIG. 18) serving as a goods storage of the present invention. The gradient storage shelf 7004 consists of gravity roller conveyors 7001 arranged in stories and columns. Each of the gravity roller conveyors 7001 is inclined unidirectionally and has an inlet located at a higher end thereof and an outlet located at a lower end thereof. The goods feeder 6000 can feed goods to the gravity roller conveyors 7001 arranged in stories and columns. Goods fed in the gradient storage shelf 7004 consisting of the gravity roller conveyors 7001 move from the inlets to the outlets due to their own weights, and automatically lined up on the gravity roller conveyors 7001.

Next, the components of the goods arrangement system will be described in detail.

Figure 2:
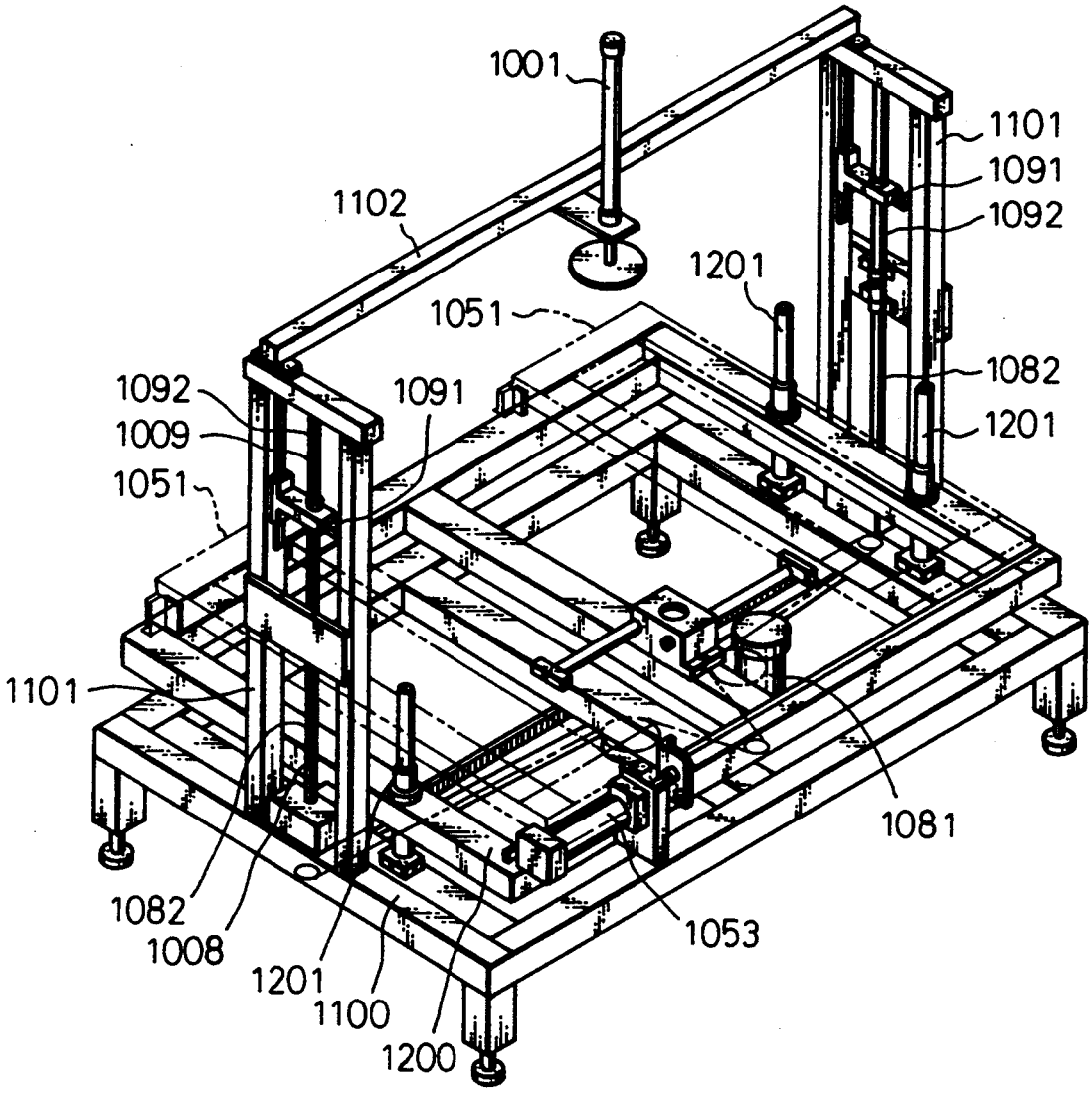
FIG. 2 is a partly enlarged perspective view showing an unpacker for a carton box containing goods in FIG. 1 and excluding back and front moving bases.
Figure 3:
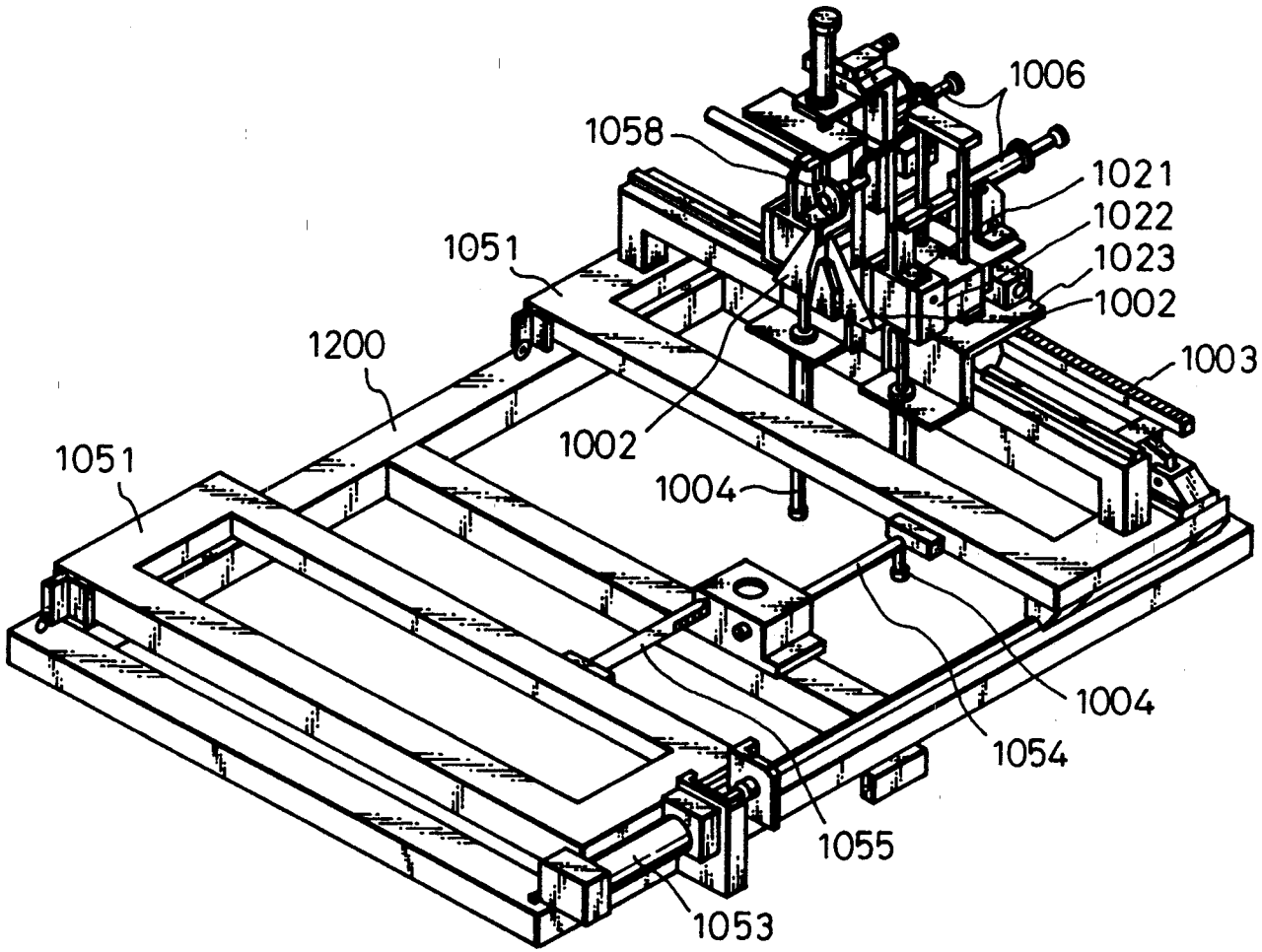
FIG. 3 is an oblique view showing back and front moving bases mounted on a lift frame.

FIGS. 2 to 4 show an unpacker 1000 for peeling off an upper outer flap F1 of a box B. As shown in FIG. 2, the unpacker 1000 consists of a base frame 1100, and a lift frame 1200 mounted on the base frame 1100 so as to be movable vertically along guide rods 1201. A pair of vertical frames 1101 are mounted on the ends of the base frame 1100 so as to face each other. A horizontal bar 1102 is bridged between the upper ends of the vertical frames 1101. A box holder 1001 is attached to the horizontal bar 1102 so as to face down.

Feed screws 1082 constituting a lift 1008 that assists the lift frame 1200 in ascending or descending are supported by the vertical frames 1101 so as to be rotatable. The feed screws 1082 are mated with nuts (not shown) attached to the lift frame 1200, thus causing the lift frame 1200 to ascend or descend. A drive 1081 drives the feed screws 1082 via a chain. The upper portions of the feed screws 1082 serve as feed screws 1009 for a detector lift 1009. The feed screws 1009 causes the detector 1091 for detecting the top P1 of a box B to ascend or descend. The pitch of the feed screws 1009 is double the pitch of the feed screws 1082.

As shown in FIGS. 2 and 3, a pair of back and front moving bases 1051 are mounted on the lift frame 1200. A roller conveyor 9001 shown in FIG. 1 passes above the pair of back and front moving bases 1051 between the vertical frames 1101. A box B is carried in such a manner that the sides P3 thereof will be opposed to the vertical frames 1101. When the box B comes above the back and front moving bases 1051, the box holder 1001 operates downward to hold the box B in place. Herein, back and forth means the back and forth viewed from the left of FIG. 1 or 3. The front moving base 1051 is the left one in FIG. 3.

As shown in FIG. 3, the lift frame 1200 has an air cylinder 1053 for moving the back moving base 1051, which is the right one in FIG. 3, back and forth (left and right in FIG. 2). The front moving base 1051 is coupled with the back moving base 1051 via racks 1054 and 1055, and a pinion (not shown). The back and front moving bases 1051 can move synchronously in opposite directions.

A member for opening the upper outer flap of one of the sides P3 of a box B is mounted on an end of the back moving base 1051. FIG. 3 omits a member for opening another upper outer flap from the front moving base 1051. The member on the front moving base is the same as the one on the back moving base 1051. The members are arranged symmetrically.

The back moving base 1051 has a pair of plate tongues 1002 for opening the upper outer flap F1 and a sucker for sucking the upper outer flap F1. Each of the plate tongues 1002 is attached to a swing arm 1021 supported by a piston rod of a lift air cylinder 1004. The swing arms 1021 are attached to brackets 1022 so as to swing. Swing air cylinders 1006 are arranged so as to engage with the upper ends of the swing arms 1021. When the upper ends of the swing arms 1021 are pushed out, the swing arms 1021 turn counterclockwise together with the plate tongues 1002.

The brackets 1022 of the swing arms 1021 are attached to the piston rods of the air cylinders 1004. The air cylinders 1004 are mounted on a slider 1023. The slider 1023 has a pinion (not shown) that engages with a rack 1003. When the pinion is driven, the slider moves in a direction in which boxes B are carried and in the opposite direction; that is, in arrow directions in FIG. 4B.

When the unpacker 1000 is actuated, boxes B are carried by the roller conveyor 9001, transported one by one to the unpacker 1000 due to the operation of the stopper 9002, and then halted by a stopper 9003 at the position of the unpacker 1000. When the detectors 1091 ascend or descend to detect the top P1 of a box B, the lift frame 1200 ascends or descends simultaneously. The tips of the plate tongues 1002 come to a position slightly lower than upper outer flaps F1 on the sides P3 of the box B.

Figure 4B:
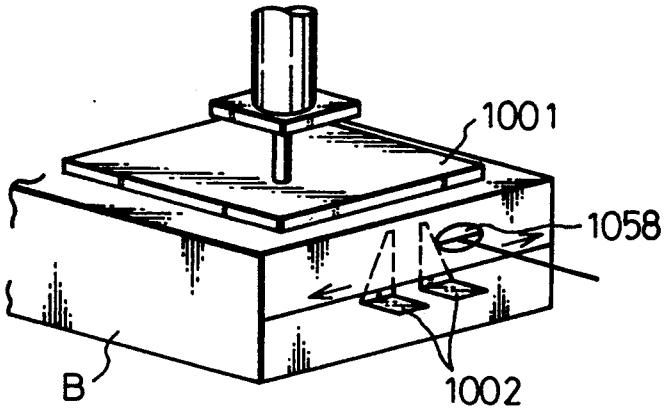
Figure 4C:
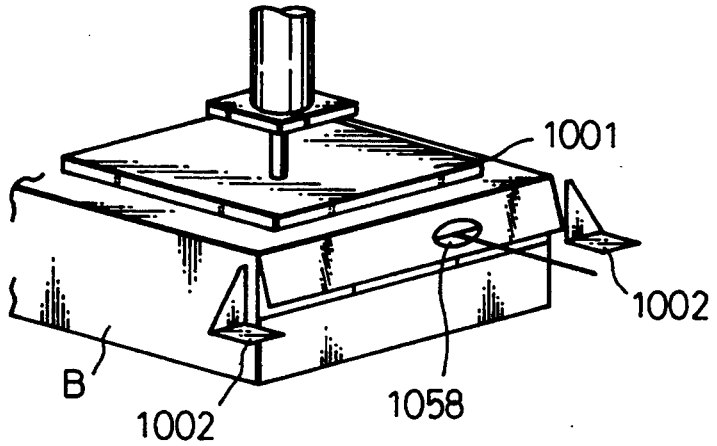

The air cylinder 1053 is then actuated, causing the back and front moving bases 1051 to move toward the sides P3 of the box B. When the tips of the plate tongues 1002 come close to the sides P3 of the box B, the back and front moving bases 1051 are stopped. The swing air cylinders 1006 are then actuated, causing the plate tongues 1002 to swing toward the sides of the box B. At the same time, the suckers 1058 provide vacuum to suck the upper outer flaps F1 on the sides P3 of the box B (FIG. 4A). This brings about a gap between the upper outer flap F1 and inner flaps F3 on each of the sides P3 of the box B. The lift air cylinders 1004 are then actuated to insert the plate tongues 1002 inside the upper outer flaps F1. The sliders 1023 are then actuated, causing the plate tongues 1002 to move horizontally along the upper outer flaps F1 toward the inner flaps F3 (FIG. 4B). The plate tongues 1002 then peel the upper outer flaps F1 from the inner flaps F3 (FIG. 4C). When the upper outer flaps F1 are peeled from the inner flaps F3, the stopper 9003 moves down. The box B is then carried out to the unpacker 2000 in the next stage by the roller conveyor 9001. The unpacker 1000 returns to the initial position for unpacking a subsequent box B.

The unpacker 2000 has substantially the same structure as the unpacker 1000, including plate tongues similar to the foregoing plate tongues 1002. The plate tongues are, however, mounted to face down, thus peeling lower outer flaps F2 from inner flaps F3.

Figure 5:
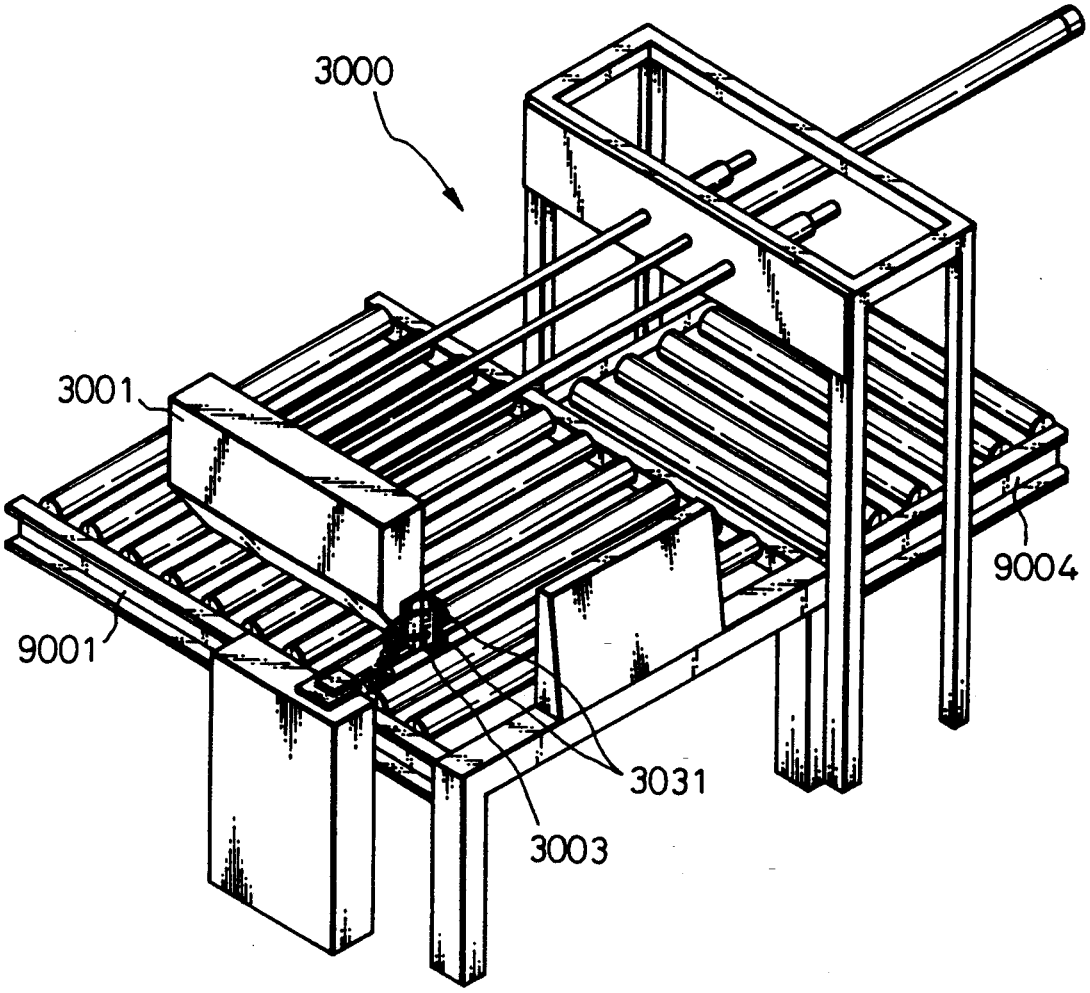
FIG. 5 is a partly enlarged oblique view showing a pusher for pushing a box that is shown in FIG. 1.
Figure 6:
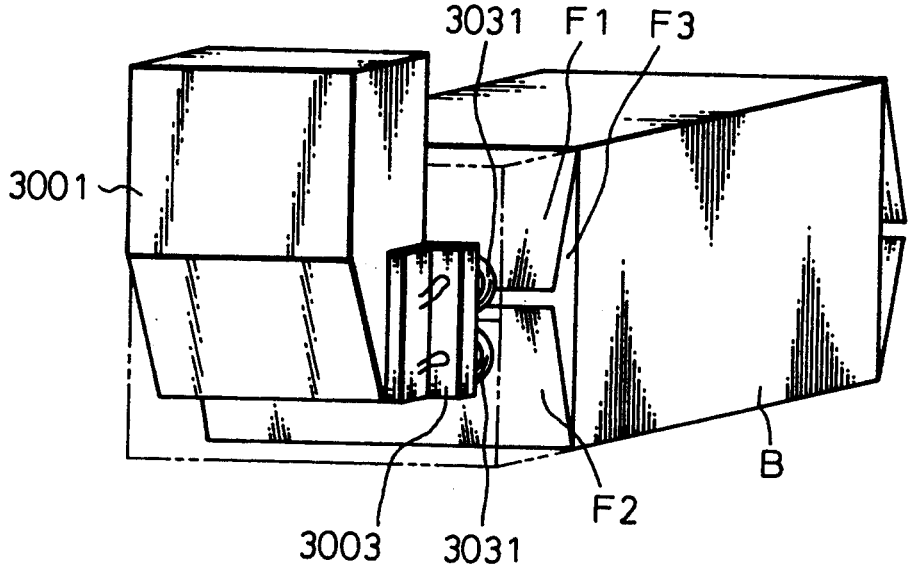
FIG. 6 is an oblique view showing a box being pushed by the pusher plate in FIG. 5.

FIG. 5 shows a pusher 3000 for pushing out a box B. FIG. 5 views the pusher 3000 in the opposite direction of FIG. 1. FIG. 6 shows box B being pushed by a pusher plate 9001 in FIG. 5. The pusher 3000 is installed at an intersection between a roller conveyor 9001 and a roller conveyor 9004 extending perpendicularly to the roller conveyor 9001. The pusher 3000 has the pusher plate 9001 for pushing one of the sides P3 of the box B whose outer flaps F1 and F2 have been opened. The pusher plate 9001 is coupled with an air cylinder, which is not shown, and movable horizontally. A sucker 3003 is mounted on a side of the pusher plate 9001 and movable together with the pusher plate 9001. The sucker 3003 includes a pair of up and down suction pads 3031. The upper suction pad 3031 adheres to an upper outer flap F1 as shown in FIG. 6, and the lower suction pad 3031 adheres to a lower outer flap F1.

When the pusher 3000 is actuated, the pusher plate 9001 moves rightward in FIG. 5 (leftward in FIG. 1) owing to an air cylinder which is not shown, and thus carries the box B from the roller conveyor 9001 to the roller conveyor 9004. The box B is oriented on the roller conveyor 9001 in such a way that the flaps F1 and F2 will face the side margin of the roller conveyor 9001. The orientation is changed by the pusher 3000. On the roller conveyor 9004, the flaps F1 and F2 face the front and back respectively in the direction in which the box B is carried.

As indicated with an alternate long and two short dashes line in FIG. 6, the pusher plate 9001 presses the outer flaps F1 and F2, which are released from one of the sides P3 of the box B, so as to crush them. If merely pressed, the outer flaps F1 and F2 may be locked in the inner flaps F3. In this invention, the suction pads 3031 suck the upper outer flap F1 and lower outer flap F2 respectively, thus preventing the outer flaps F1 and F2 from being locked in the flaps F3. When the box B is carried by the roller conveyor 9004, the pusher plate 9001 parts from the box B. The suction pads 3031 pull out the upper outer flap F1 and lower outer flap F2 backward in the direction in which the box B is carried, thus reliably preventing the outer flaps from being locked.

Figure 7:
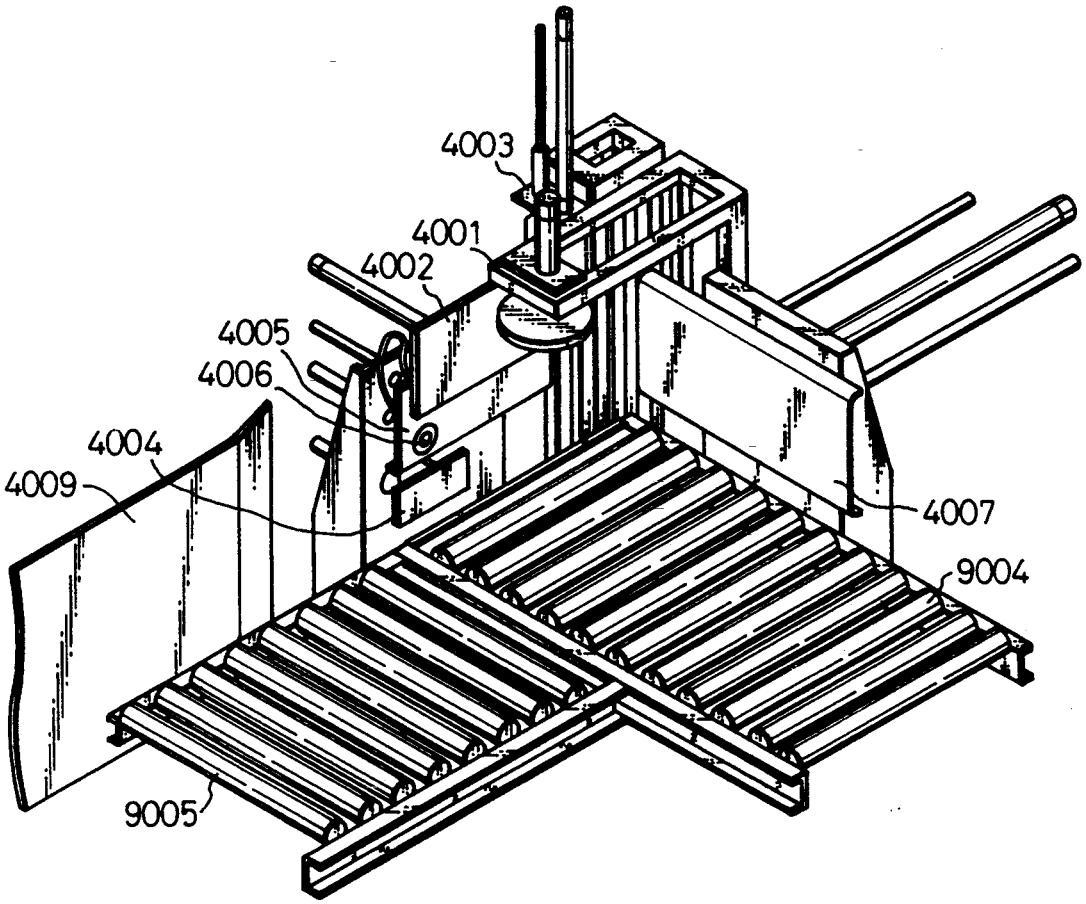
FIG. 7 is a partly enlarged oblique view showing a flap opener in FIG. 1.
Figure 8:
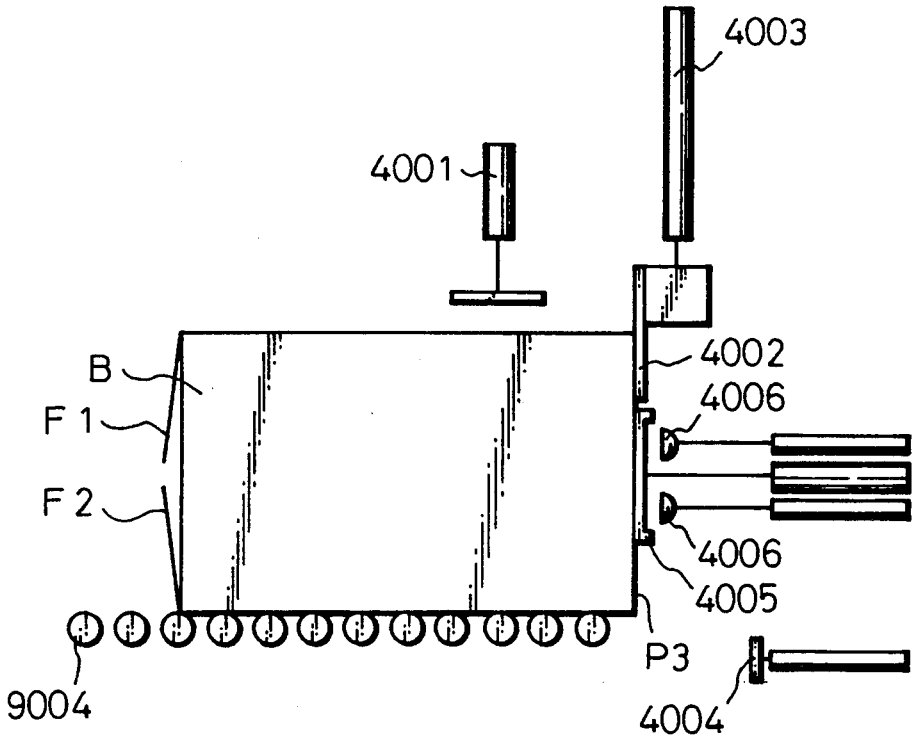
FIG. 8 is a side view showing the procedure of opening an upper outer flap and a lower outer flap in the flap opener in FIG. 7.
Figure 9:
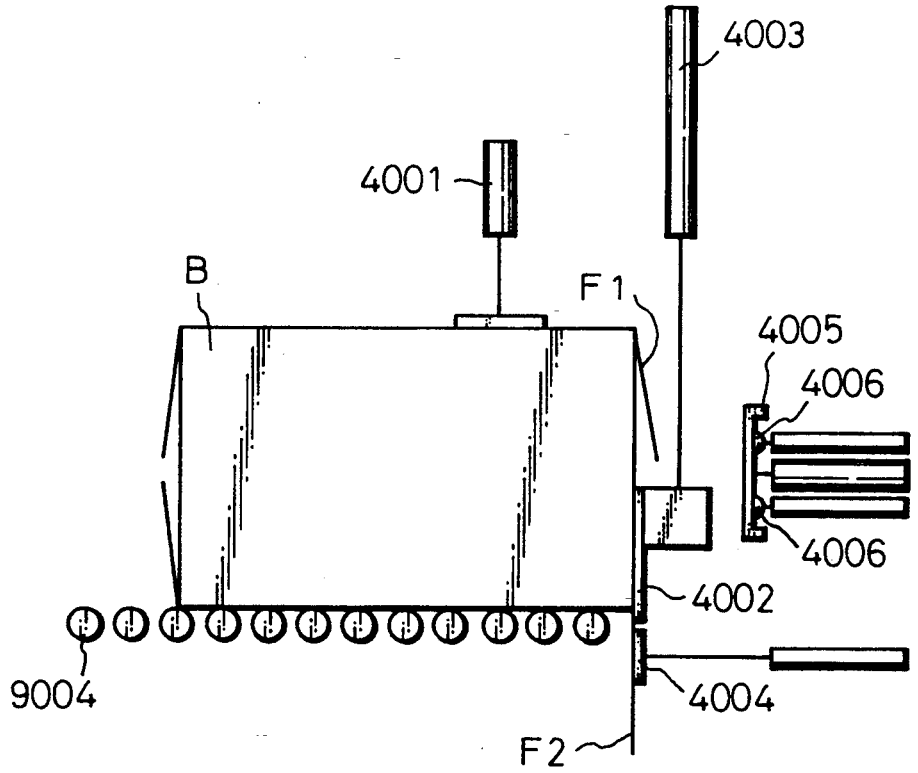
FIG. 9 is a side view showing the procedure of opening an upper outer flap and a lower outer flap that succeeds the procedure in FIG. 8.
Figure 10:
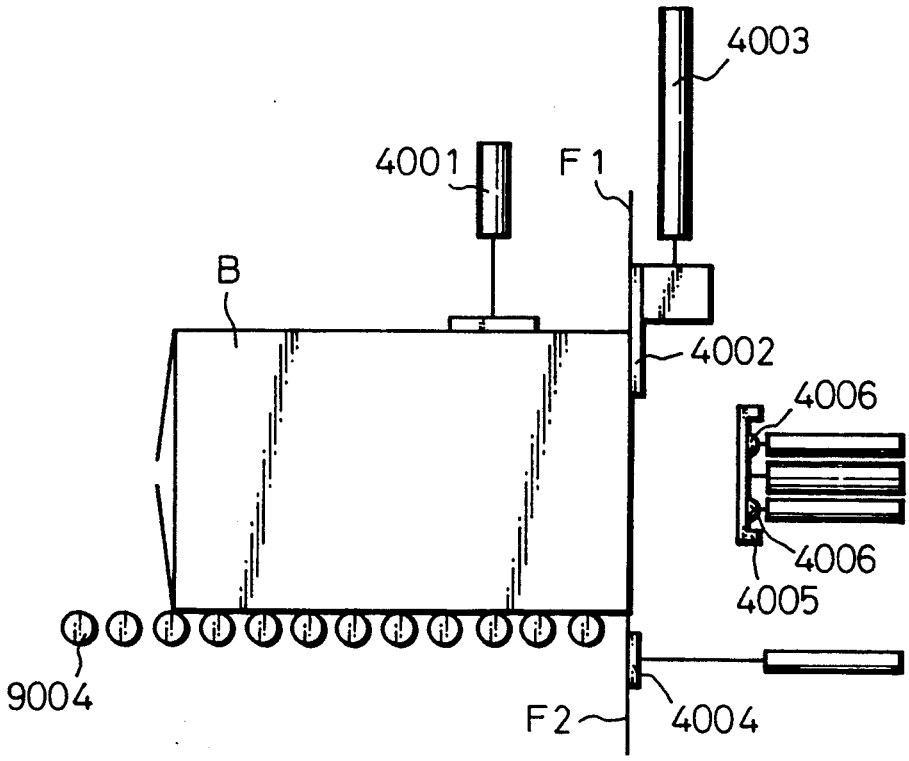
FIG. 10 is a side view showing the procedure of opening an upper outer flap and a lower outer flap that succeeds the procedure in FIG. 9.

FIG. 7 is an enlarged oblique view showing a flap opener 4000. FIG. 7 views the flap opener 4000 in the opposite direction of FIG. 1. FIGS. 8 to 10 are side views showing a procedure of opening an upper outer flap F1 and a lower outer flap F2 in the flap opener 4000 shown in FIG. 7. The flap opener 4000 is installed at an intersection between a roller conveyor 9004 and a roller conveyor 9005 extending perpendicularly to the roller conveyor 9004.

The flap opener 4000 comprises a box presser 4001 for holding the top P1 of a box B, a flap opening plate 4002 for opening the outer flaps F1 and F2 of a preceding one of the sides P3 of the box B carried by the roller conveyor 9004, an air cylinder 4003 for operating the flap open plate 4002 vertically, a holder 4004 for holding the opened lower outer flap F2, and a stopper 4005. The flap open plate 4002 has an air nozzle (not shown). Suction pads 4006 are provided at positions such that they can be seen from holes on the stopper 4005. A pusher plate 4007 is installed to move the box B from the roller conveyor 9004 to the roller conveyor 9005, and a flap guide plate 4009 is installed along one side of the roller conveyor 9005.

When the flap opener 4000 is actuated, as shown in FIG. 8, the box B is carried from the left to the right in FIG. 8 by the roller conveyor 9004, and collides with the stopper 4005 and stops. At this time, the outer flaps F1 and F2 on a preceding one of the sides P3 are pressed to the inner flaps F. The suction pads 4006 cause the lower outer flap F2 to open slightly. The flap open plate 4002 is located above the stopper 4005. As shown in FIG. 9, when the box B hits the stopper 4005 and stops, the flap open plate 4002 descends along the side P3 of the box B. This causes the stopper 4005 to withdraw. The flap open plate 4002 passes through the upper outer flap F1, invades into the slightly-opened lower outer flap F2, and then opens the lower outer flap F2. The holder 4004 advances to hold the lower outer flap F2 open. The flap open plate 4002 then goes up as shown in FIG. 10 to open the upper outer flap F1. The holder 4004 adheres to the lower outer flap F2, and the flap open plate 4002 adheres to the upper outer flap F1. The pusher plate 4007 is then actuated to push out the box B onto the roller conveyor 9005. The flap guide 4009 adheres to the upper outer flap F1 and lower outer flap F2. The box B is carried by the roller conveyor 9005 with the upper outer flap F1 and lower outer flap F2 held open.

Figure 11:
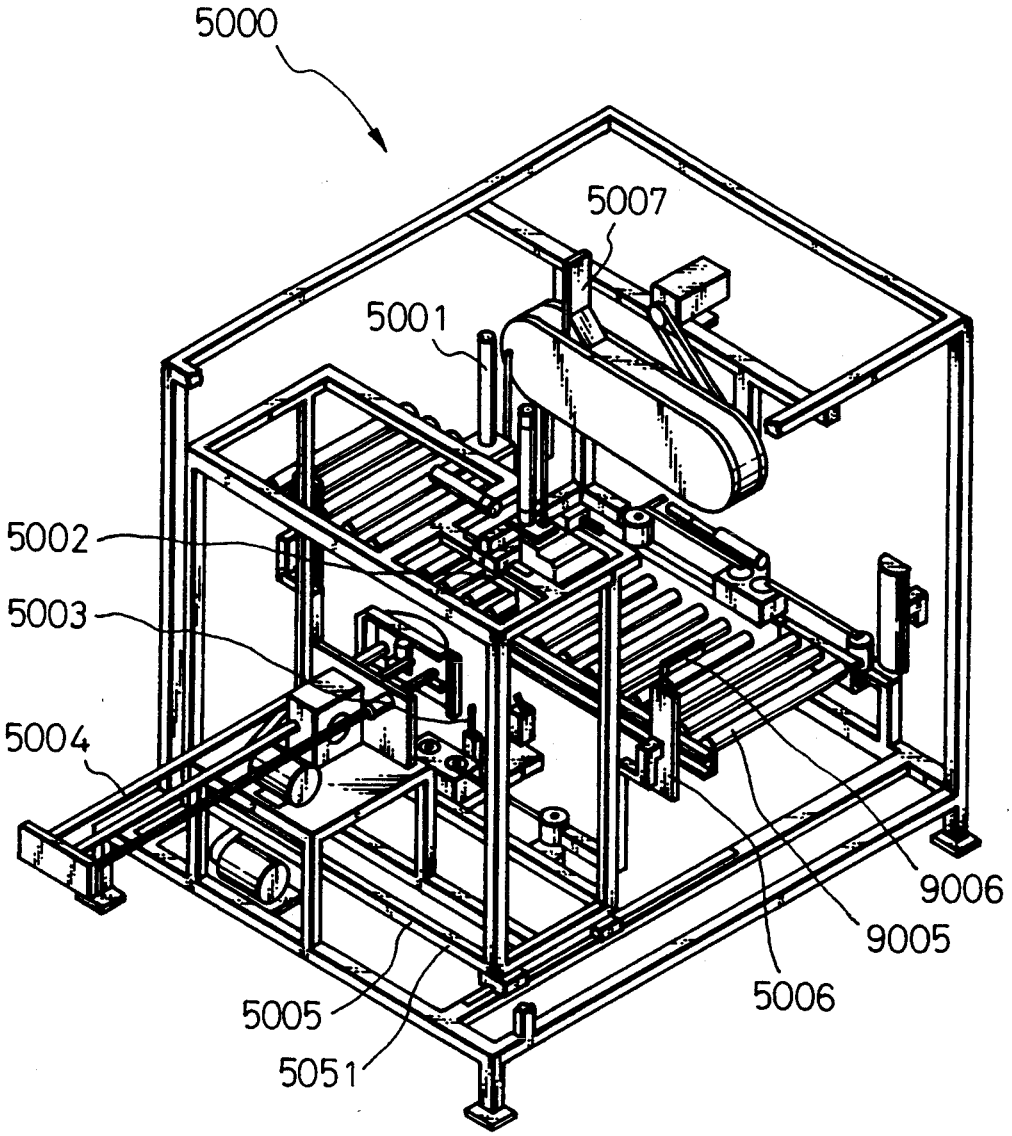
FIG. 11 is a partly enlarged oblique view showing the goods takeout apparatus in FIG. 1.
Figure 12:
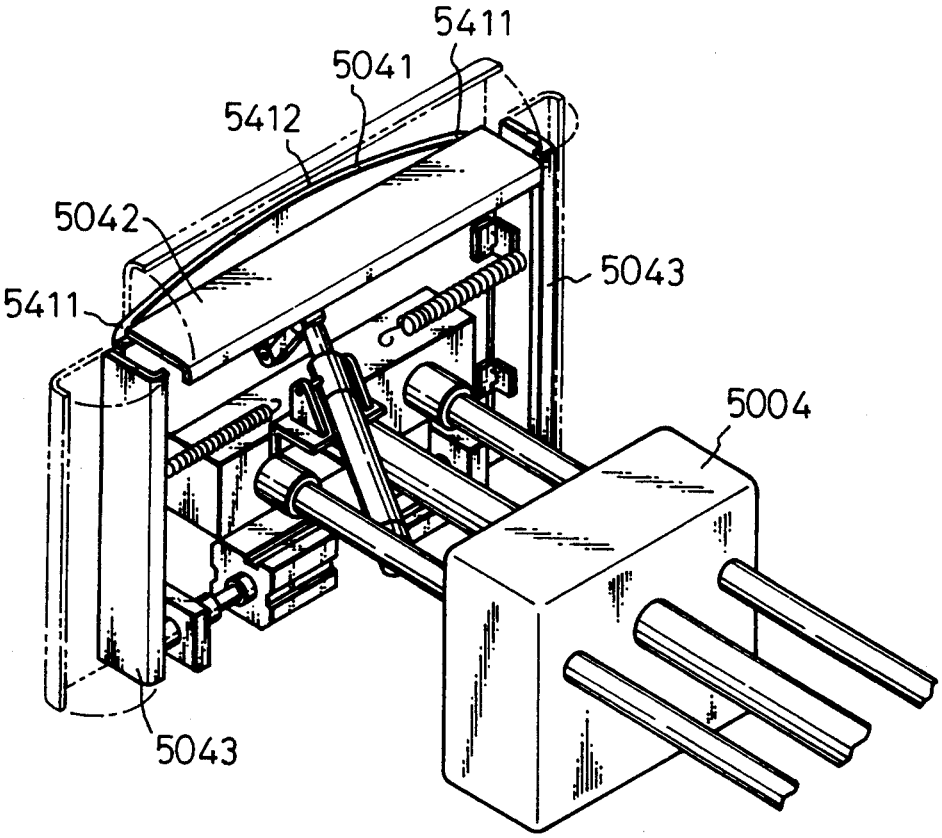
FIG. 12 is a partly enlarge oblique view showing a pusher of the goods takeout apparatus in FIG. 11.
Figure 13:
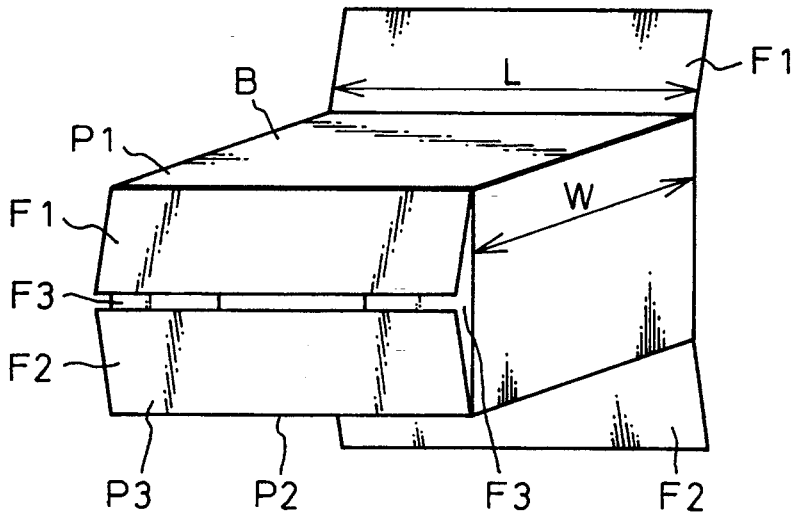
FIG. 13 is an enlarged oblique view showing the state in which an upper outer flap and a lower outer flap in one side of a box have been opened by the flap opener in FIG. 7.

FIG. 11 is a partly-enlarged oblique view showing an goods takeout apparatus 5000. FIG. 11 views the takeout apparatus 5000 in the opposite direction of FIG. 1. FIG. 12 shows a pusher 5004 in FIG. 11. A box B is, as shown in FIG. 13, carried to the goods takeout apparatus 5000 with the outer flaps F1 and F2 on one of the sides P3 thereof held open. In this case, the opened side P3 is located in the left of FIG. 11 (the right of FIG. 1).

Figure 14:
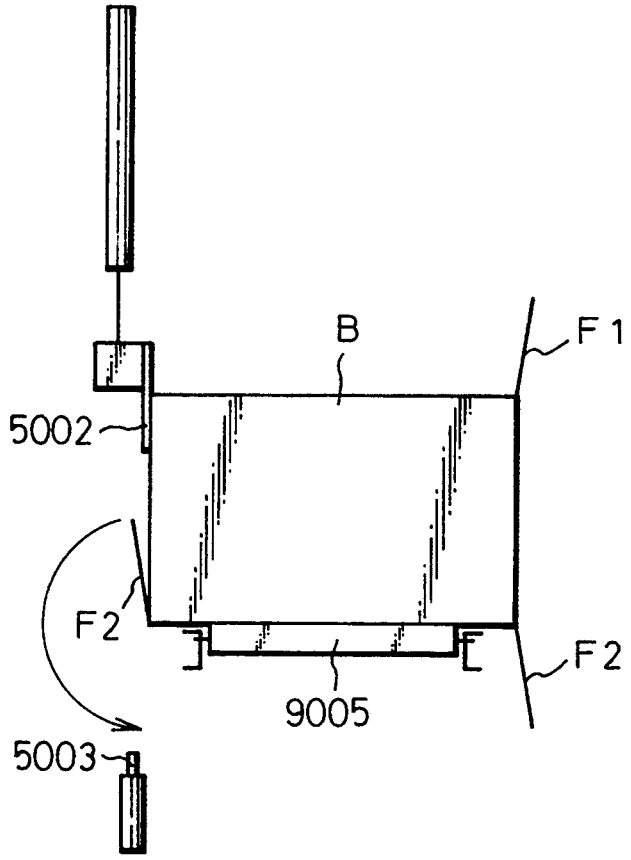
FIG. 14 is an enlarged oblique view showing the state in which an upper outer flap and a lower outer flap in the other side of a box have been opened in the goods takeout apparatus in FIG. 11.

The goods takeout apparatus 5000 comprises a box presser 5001, a flap open plate 5002 (FIG. 14) that ascends or descends along an unopened one of the sides P3 in order to open the outer flaps F1 and F2 on the unopened side P3, a press bar 5003 for restricting the return of the opened lower outer flap F2, and a pusher 5004 for pushing out goods from the box B. As shown in FIG. 12, the pusher 5004 has a pusher plate 5041. The pusher plate 5041 is shaped like a circle having a cylindrical surface. The ends 5411 of the pusher plate 5041 are therefore located deeper than the center 5412 thereof.

The goods takeout apparatus 5000 includes a lateral aligner 5005 for aligning the width of the flap open plate 9002 with the width W of the box B (FIG. 13), a longitudinal centering device 5006 for centering the box B according to the length L thereof and an empty box discharger 5007 for discharging the emptied box B. The lateral aligner 5005 includes back and front moving bases 5051.

When the goods takeout apparatus 5000 is actuated, the box B is carried by the roller conveyor 9005, as shown in FIG. 13, with the outer flaps F1 and F2 on one of the sides P3 thereof held open but with the underlying inner flaps F3 held unopened. The box B then collides with a stopper 9006 and stops. At this time, the outer flaps F1 and F2 on the opposite side P3 have not been opened. When the box B reaches the stopper 9006, the back and front moving bases 5051 of the lateral aligner 5005 advance according to the width of the box B, and stop at a position at which the flap open plate 5002 comes into contact with the unopened side P3. The flap open plate 5002 and presser bar 5003 open the outer flaps F1 and F2 similarly to the doors of the flap opener 4000.

The pusher plate 5041 of the pusher 5004 is inserted into the side P3 having the outer flaps F1 and F2 which have just opened. The inner flaps F3 of the side P3 are then pushed into the box B by the pusher plate 5041. Goods in the box B are pushed out of the opposite side P3 by the pusher plate 5041, and thus taken out. As described above, the pusher plate 5041 is shaped like a small-diameter circle having a cylindrical surface. The ends 5411 of the pusher plate 5041 are located deeper than the center 5412 thereof. The goods in the box B are therefore discharged smoothly without being caught between the inner flaps F3 of the side P3 in which the pusher plate 5041 is inserted and the inner wall of the box B. The inner flaps F3 on the opposite side P3 are opened outside by the goods discharged.

As shown in FIG. 12, supplementary pusher plates 5042 and 5043, which can be folded, can be installed, if necessary, depending on the sizes of the sides P3 of the box B. The supplementary pusher plate 5042 is attached to the upper part of the pusher plate 5041, while the supplementary pusher plates 5043 are attached to the sides of the pusher plate 5041. The supplementary pusher plates can be unfolded, as indicated with alternate long and two short dashes lines, on the extended surface of the pusher plate 5041.

Figure 16:
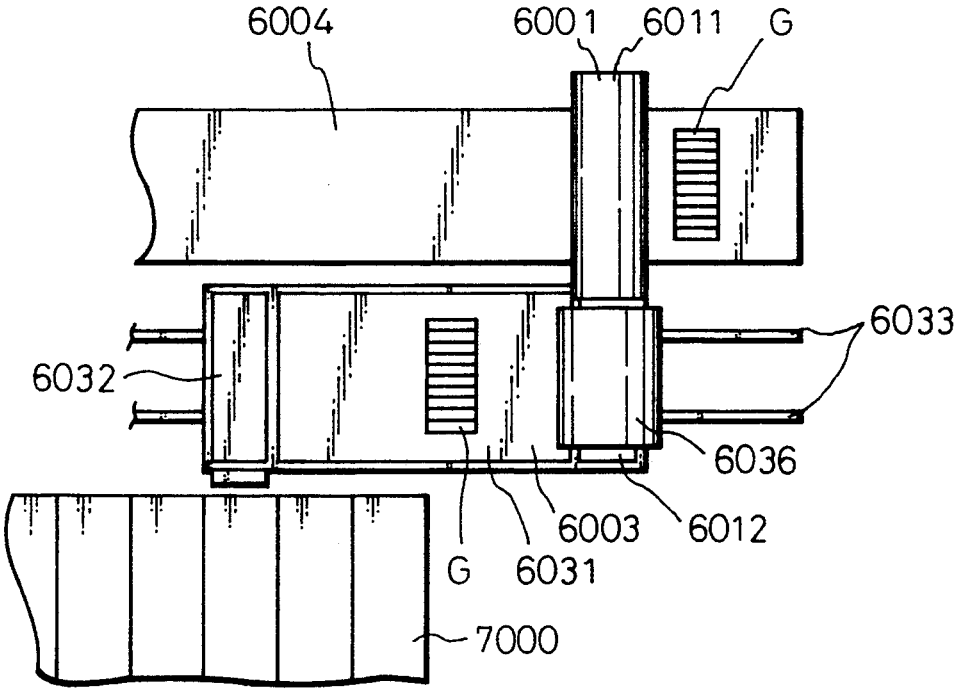
FIG. 16 is a plan view of the goods feeder in FIG. 15.
Figure 17:
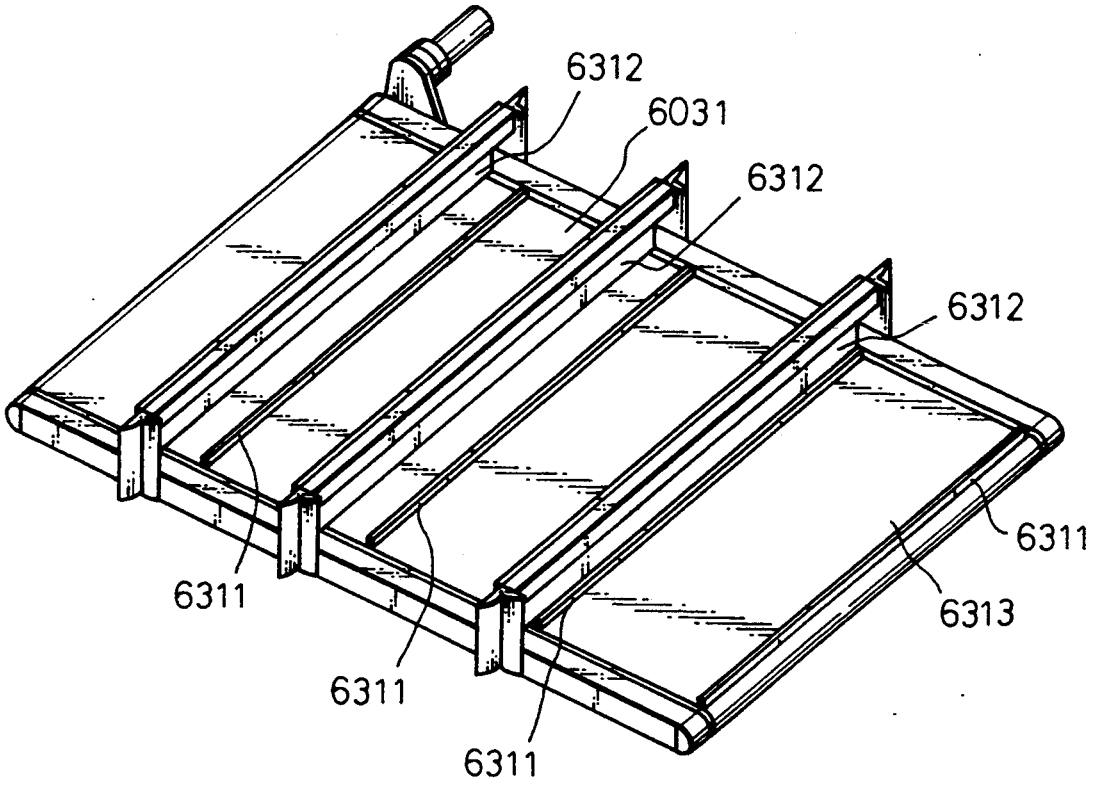
FIG. 17 is an oblique view of a swing conveyor in FIG. 15.

FIG. 15 shows a goods feeder 6000. FIG. 16 is a plan view of the goods feeder 6000 in FIG. 15. FIG. 17 is an oblique view of a swing conveyor in FIG. 15.

In this embodiment, as shown in FIG. 1, a layer breaker 9007 is installed between the goods takeout apparatus 5000 and the goods feeder 6000. A box B contains, for example, 50 goods of the same item. The goods are lined in tens and stacked in five layers. The layer breaker 9007 evens the goods taken out in layers by the goods takeout apparatus 5000 and provides five rows of ten goods. As shown in FIG. 16, the rows of ten goods G are carried to the goods feeder 6000 by a carrier belt 6004.

The goods feeder 6000 includes a running unit 6003 made up of rails 6033 (FIG. 16) laid along the warehousing frontage of a goods storage arrangement shelf 7004, and a running cart 6034 running on the rails. A swing conveyor 6031 is mounted on the running unit 6003. A goods take-in device 6001 extends sideways from one end of the running cart 6034. The carrier belt 6004 runs substantially in parallel with the rails 6033 at a height corresponding to the middle story of the warehousing frontage of the goods storage arrangement shelf 7004.

The goods take-in device 6001 overhangs sideways from the running cart 6034, and consists of a take-in ram 6011 located above the carrier belt 6004 and a belt conveyor 6012 located at an end of the running cart 6034. The take-in ram 6011 consists of a stopper bar 6013 extending immediately above the carrier belt 6004 so as to cross the carrier belt 6004, a chain 6014 running in a direction perpendicular to the carrier belt 6004, and a chip 6015 attached to the chain 6014. The stopper bar 6013 stops goods G in a row sideways, the chip 6015 pushes the goods G in a row with the rotation of the chain 7014, and then the belt conveyor 1012 carries the goods G in a row to an end of the running cart 6034.

A feed ram 6036 is installed above the belt conveyor 1012, consisting of a chain 6037 running in the longitudinal direction of the running cart 6034 and a chip 6038 attached to the chain 6037. The chip 6038 feeds goods G in a row sideways to the swing conveyor 6031 with the rotation of the chain 6037. A warehousing device 6032 is mounted in the opposite side of the feed ram 6036 on the running cart 6034 with the swing conveyor 6031 between them.

As shown in FIG. 17, the swing conveyor 6031 includes a running belt 6313. Crosspieces 6311 are installed at regular intervals on the running belt 6313. Pendulous members 6312, which look like curtains and are made of rigid rubber, are resting on the swing conveyor 6031. The bottoms of the pendulous members 6312 are located lower than the tops of the goods G. When the feed ram 6036 feeds the goods G to the portion of the swing conveyor 6031 between adjacent crosspieces 6311, the goods G move together with the swing conveyor 6031. When the goods G hit any of the pendulous members 6312, the pendulous member 6312 hinders the movement of the goods G, causes the goods to slide on the running belt 6313, and thus pushes the goods to the succeeding crosspiece 6311. The goods G are carried by the crosspiece 6311, forcibly bend the pendulous member 6312, and thus pass through the pendulous member 6312. With the actions of the pendulous member 6312 and crosspiece 6311, the goods G are forcibly aligned with the crosspiece 6311. The goods G are then carried to the warehousing device 6032.

As shown in FIG. 15, one end of the swing conveyor 6031 is fixed to a lift base 6351 of a lift 6035. The lift base 6351 is moved vertically by means of a motor and an endless timing belt 6316. A wheel 6314 is attached to the bottom of the other end of the swing conveyor 6031. The wheel 6314 can move horizontally along a horizontal frame 6315 formed in the upper part of the running cart 6034. When one end of the swing conveyor 6031 moves vertically together with the lift base 6351 of the lift 6035, the other end of the swing conveyor 6032 moves horizontally along the horizontal frame 6315. The swing conveyor 6032 thus tilts with one end thereof at an intended height, enabling smooth transport of the goods G.

As shown in FIG. 15, the warehousing device 6032 has a warehousing feed ram 6321 attached to the lift base 6351. The warehousing feed ram 6321 consists of a chain 6322 running across the running cart 6034 and a chip 6323 attached to the chain 6322. The chip 6323 feeds the goods G in a row to the goods storage arrangement shelf 7000 with the rotation of the chain 6322. The warehousing device 6032 ascends or descends owing to the lift 6035.

When the goods feeder 6000 is actuated, the goods take-in device 6001 takes in goods G when the running cart 6034 stops. The goods G are then carried to the warehousing device 6032 via the feed ram 36 and swing conveyor 6031. In the meantime, the warehousing device 6032 comes to a designated position in the warehousing frontage of the goods storage arrangement apparatus 7000 depending on the position to which the running cart 6034 runs and on the position to which the lift 6035 ascends or descends. The chip 6323 feeds the goods G in a row to the specified position in the warehousing frontage of the goods storage arrangement apparatus 7004 with the rotation of the chain 6322. The warehousing device 6032 enters a standby state at the next designated position depending on the running of the running cart 6034 and on the ascending or descending of the lift 6035. In this embodiment, the box B contains the goods G of the same item. The carrier belt 6004 carries the goods G in rows of ten pieces. The warehousing device 6032 carries the goods G in rows of ten pieces to the goods storage arrangement shelf 7000. The goods storage arrangement shelf 7000, consisting of five-storied shelves, supplies the goods G to the shelves on each story, wherein fifty pieces of goods G contained in a box B are supplied in tens.

Figure 18:
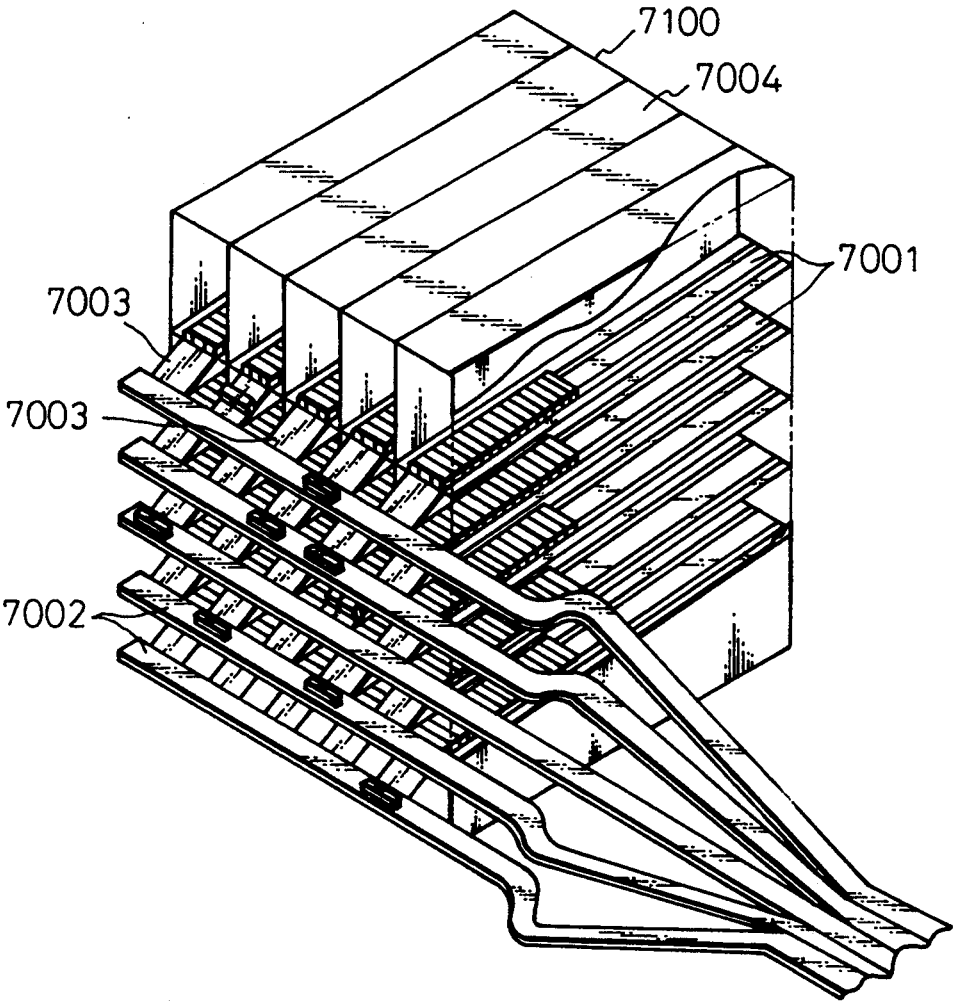
FIG. 18 is a partly enlarged oblique view showing the goods storage arrangement apparatus in FIG. 1.

FIG. 18 is a partly enlarged oblique view showing the goods storage arrangement apparatus 7000. Unlike FIG. 1, FIG. 18 is a schematic drawing assisting in easy understanding of the features of the goods storage arrangement apparatus.

As described above, the goods storage arrangement device 7000 includes a gradient storage shelf 7004. The gradient storage shelf 7004 consists of gravity roller conveyors 7001 arranged in stories and columns. The gravity roller conveyors 7001 are inclined unidirectionally and have inlets located at higher ends thereof and outlets located at lower ends thereof. Goods supplied to the gradient storage shelf 7004 consisting of the gravity roller conveyors 7001 move from the inlets to the outlets due to their own weights.

The inlets of all the gravity roller conveyors 7001 are present on the same vertical plane, forming a warehousing frontage 7100. A warehousing device 6032 of an goods feeder 6000 can be positioned at any designated one of the inlets of the gravity roller conveyors 7001 constituting the warehousing frontage 7100. The outlets of all gravity roller conveyors are present on the same vertical plane. Each of the outlets of the gravity roller conveyors 7001 is provided with a takeout mechanism 7003. Multiple gravity roller conveyors 7001 are linked with arrangement conveyors 7002 via the takeout mechanisms 7003.

Figure 20:
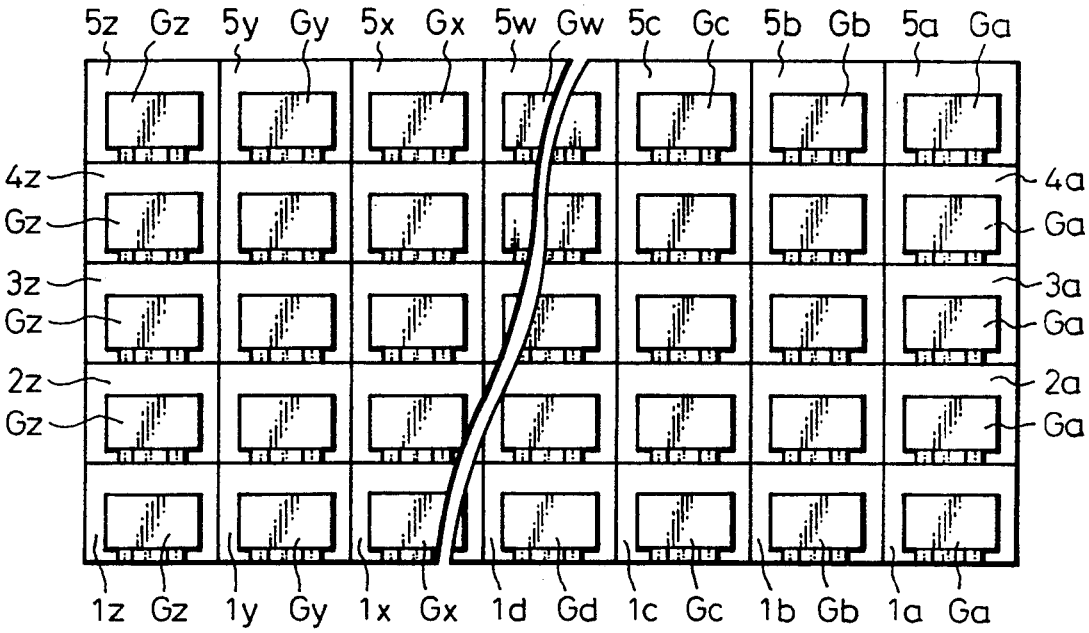
FIG. 20 is a vertical cross section of a flow shelf of the goods storage arrangement apparatus in FIG. 18.

The gravity roller conveyors 7001 are arranged in ten columns in FIG. 1, five columns in FIG. 8, and twenty columns in FIG. 20. The variation in the number of columns of gravity roller conveyors aims at simplification of description. The gravity roller conveyors 7001 may be arranged in any columns. The gravity roller conveyors 7001 are arranged in five columns. The arrangement conveyors 7002 number five. Each of the arrangement conveyors 7002 is linked with all the takeout mechanisms 7003 for the gravity roller conveyors 7001 in each story. The gravity roller conveyors 7001 may therefore be referred to as branch lines, while the arrangement conveyors 7002 may be referred to as main lines.

Figure 19:
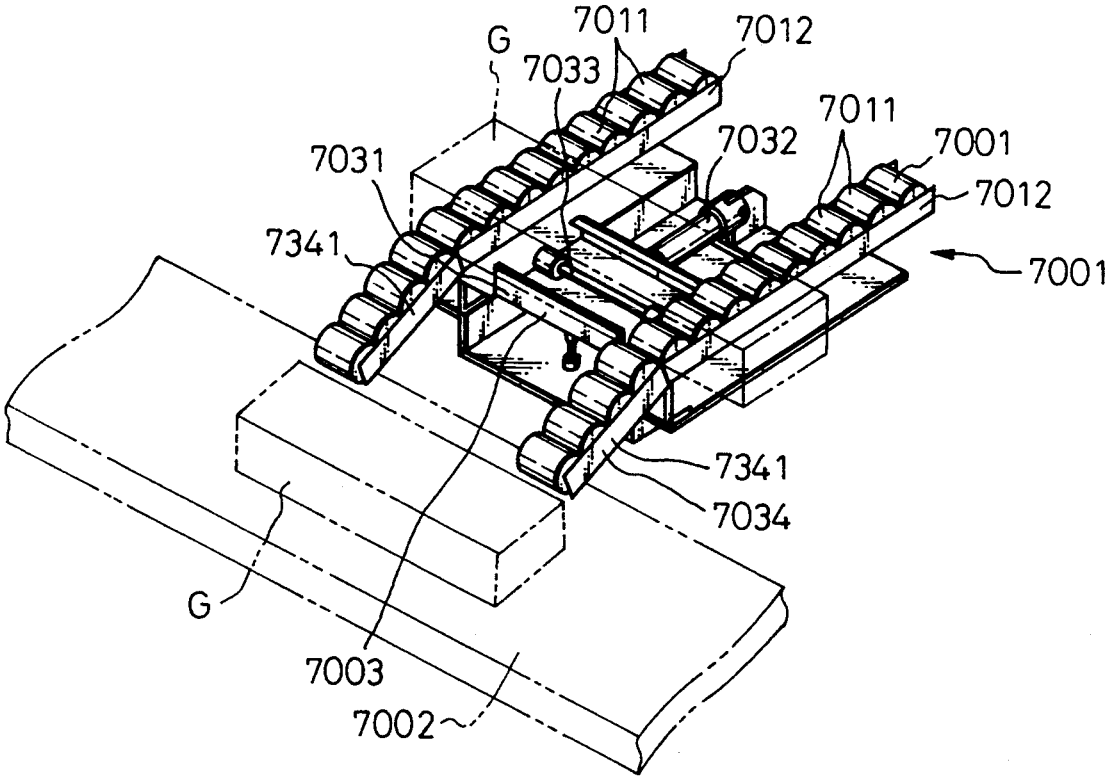
FIG. 19 is a perspective view of the distal portion of a gravity roller conveyor of the goods storage arrangement apparatus in FIG. 18.

As shown in FIG. 19, a gravity roller conveyor 7001 is made up of a pair of parallel rail frames 7012 and multiple rollers 7011 mounted in the rail frames. The rail frames 7012 are inclined as described above. Supplied goods G move on the gravity roller conveyor 7001 with their own weights and are fed sequentially through the outlet to line up. When the associated takeout mechanism 7003 is actuated, the goods are taken out onto an arrangement conveyor 7002 one by one in the order in which they arrived.

The takeout mechanism 7003 consists of a stopper 7003 that is placed between a pair of parallel rail frames 7012 and has a U-shaped cross section, and a chute 7004 placed at the downstream of the stopper 7003. The stopper 7003 is rotatable about a fulcrum shaft 7033 and coupled with an air cylinder 7032. The piston rod of the air cylinder 7032 is projecting all the time, and the stopper 7003 is positioned on a substantially perpendicular plane. The front arm of the U-shaped stopper 7003 projects above the rollers 7011 to stop goods G coming along the gravity roller conveyor 7001. In response to a good takeout command, the piston rod of the air cylinder 7032 withdraws, and the front arm of the U-shaped stopper 7003 goes lower than the rollers 7011. One of the goods G on the gravity roller conveyor 7001 is thus allowed to move. The back arm of the U-shaped stopper 7003 goes higher than the rollers 7011, thus stopping a succeeding one of the goods G on the gravity roller conveyor 7001. The goods G on the gravity roller conveyor 7001 can thus be taken out one by one. The chute 7034 is made up of a pair of parallel rail frames 7341 and multiple rollers mounted in the rail frames. The rail frames 7341 of the chute 7034 are inclined with a sharper slope than the rail frames 7012 of the gravity roller conveyor 7001, and merged into an arrangement conveyor 7002.

The arrangement conveyor 7002 is a belt conveyor with a pulse encoder, which is not shown, attached at a specified position. As shown in FIG. 1, the terminal portions of five arrangement conveyors 7002 come close to one another on the same horizontal plane and merge into a goods feed conveyor 8002 of a goods input apparatus 8000.

Next, referring to FIG. 20, the operation of goods arrangement for taking out goods from the goods storage arrangement apparatus 7000 and arranging them will be described.

In an embodiment shown in FIG. 20, a gradient storage shelf 7004 consists of gravity roller conveyors 7001 of five stories by 26 columns; that is, a total of 130 gravity roller conveyors. Reference numerals 1*a* to 1*z* denote gravity roller conveyors 7001 on the lowest story. 2*a* to 2*z* denote gravity roller conveyors 7001 on the second story. 5*a* to 5*z* denote gravity roller conveyors 7001 on the top story. Subscripts a to z denote the positions of the gravity roller conveyors 7001 along an arrangement conveyor 7002 on each story. The subscript a denotes the gravity roller conveyor 7001 located at the downstream end of the arrangement conveyor 7002; that is, closest to the goods input apparatus 8000. On the contrary, the subscript z denotes the gravity roller conveyor 7001 located at the upstream end of the arrangement conveyor 7002.

The gravity roller conveyors 1*a* to 1*z*, 2*a* to 2*z*, etc., 5*a* to 5*z* contain goods Ga to Gz respectively. The subscripts denote items of goods. Goods Ga of the same item are stored in the gravity roller conveyors 1*a* to 5*a* on the first column on respective stories. Goods Gb of the same item are stored in the gravity roller conveyors 1*b* to 5*b* on the second column on respective stories. Goods Gz of the same item are stored in the gravity roller conveyors 1*z* to 5*z* on the 26th column on respective stories.

The first example for arranging goods G as shown in FIG. 24 and putting them in an arrangement container C prepared in the goods input apparatus 8000 will be described. In the arrangement container C, goods Ga of the same item are arranged in m lines (for example, five lines) by n columns (for example, four columns). The goods Ga are contained in the gravity roller conveyors 1*a* to 5*a* respectively. When the good takeout mechanisms of the gravity roller conveyors 1*a* to 5*a* are released simultaneously, one good Ga can be discharged at the same position of each arrangement conveyor 7002 substantially simultaneously. When this operation is repeated another three times consecutively, four goods Ga are discharged onto each arrangement conveyor 7002. If the taken-out goods Ga are put in an arrangement container C of the goods input apparatus 8000 as they are, the goods Ga are arranged and stored as shown in FIG. 24. Even when goods of different items must be handled, they can also be arranged quickly.

Next, the second example of arranging goods of different items will be described. An arrangement container C contains, as shown in FIG. 25, goods Ga to Ge on the first column, Gf to Gj on the second column, etc., and Gp to Gt on the fifth column. For this arrangement, the gravity roller conveyors 1*a*, 2*b*, 3*c*, 4*d*, and 5*e* respectively arrange a good Ga at the leading position on the arrangement conveyor 7002 on the lowest story, a good Gb at the leading position on the arrangement conveyor 7002 on the second story, etc., and a good Ge at the leading position on the arrangement conveyor 7002 on the fifth story. Next, the gravity roller conveyors 1*a*, 2*b*, 3*c*, 4*d*, and 5*e* respectively place a good Gf on the arrangement conveyor 7002 on the lowest story, a good Gg on the arrangement conveyor 7002 on the second story, etc., and a good Ge on the arrangement conveyor 7002 on the fifth story. Subsequently, goods Gk to Gt are supplied. As a result, goods Ga, Gf, Gk, and Gp are arranged in that order on the arrangement conveyor 7002 on the lowest story, goods Gb, Gg, Gt, and Gq are arranged in that order on the arrangement conveyor 7002 on the second story, and so on. The goods G thus arranged are put in an arrangement container C of the goods input apparatus 8000.

FIGS. 26A and 26B show the third example of putting goods, part of which are of the same item and the remainder of which are of different items, in a first arrangement container C (FIG. 26A) and of putting goods, part of which are of the same item and the remainder of which are of different items, in a second arrangement container C (FIG. 26B). In either of the containers, goods are arranged in five lines by four columns. This arrangement is equivalent to the arrangement of goods in five lines by eight columns.

Figure 27:
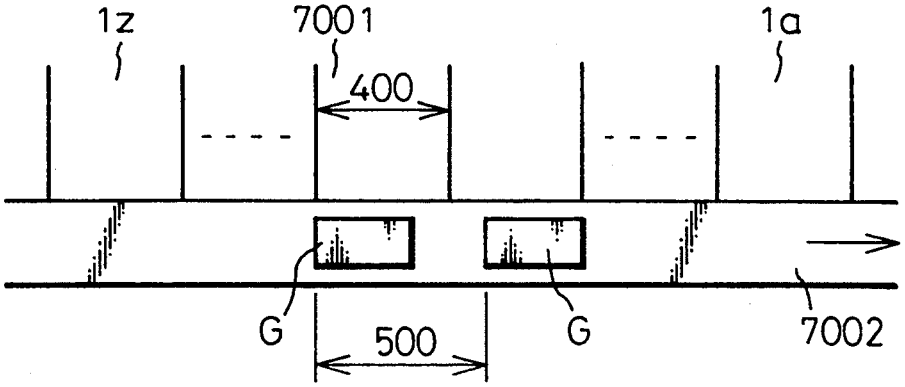
FIG. 27 illustrates goods being carried on an arrangement conveyor.

Goods Ga, Gg, Gr, Gf, Ga, Ge, Gt, Gs are arranged in that order on the arrangement conveyor 7002 on the lowest story. The details of taking these goods out of respective gravity roller conveyors 7001 will be described. As shown in FIG. 27, assuming that each good G is 300 mm long and a tolerance between goods is 200 mm, goods G are then carried on the arrangement conveyor 7002 in pitches of 500 mm. The gravity roller conveyors 7001 are lined at intervals of 400 mm. The arrangement conveyor 7002 runs in an arrow direction in FIG. 27. A gravity roller conveyor 1*z* is located downmost the arrangement conveyor 7002.

A control unit, which is not shown, issues a command saying, for example, that the goods Ga, Gg, Gr, Gf, Ga, Ge, Gt, and Gs should be carried in pitches of 500 mm. By the way, the arrangement conveyor 7002 has a pulse encoder as described above. The pulse encoder generates a pulse when the arrangement conveyor 7002 moves 1 mm. A pulse counter, which is not shown, counts pulses. The position of each of the gravity roller conveyors 7001 is corrected depending on the number of pulses, thus controlling the timing of actuating the good takeout mechanism 7003 of each of the gravity roller conveyors 7001.

As for gravity roller conveyors 1*a* to 1*z* lined along the arrangement conveyor 7002 on the lowest story, goods G are carried in pitches of 500 mm. The gravity roller conveyors are lined at intervals of 400 mm. The gravity roller conveyor 1*a* located upstream is separated from the gravity roller conveyor 1*a* located downstream by a distance of (26−1)400 mm=10,000 mm. After a good Gz is discharged from the uppermost gravity roller conveyor 1*z*, when 10,000 pulses have been counted, the good Gz comes to the downmost gravity roller conveyor 1*a*. Assuming that the position correction value for the uppermost gravity roller conveyor 1*z*, at which arrangement starts, is zero, the position correction value for the downmost gravity roller conveyor 1*a* is 10,000 pulses. In other words, the gravity roller conveyor 1*a* is actuated after 10,000 pulses have been counted up since the start of arrangement. Furthermore, the timing of carrying a good is corrected depending on an order of carrying the good. The correction value for the timing of arranging a good Ga at a leading position is zero.

Next, a good Gg succeeds the good Ga to be arranged at a leading position with a pitch of 500 mm. The good Gg is discharged from the gravity roller conveyor 1*g*. The uppermost gravity roller conveyor 1*z* is separated from the gravity roller conveyor 1*g* by a distance (26−7)400 mm=7,600 mm. The position correction value for the good Gg is therefore 7,600 pulses. The correction value for the timing of carrying the good Gg depending on the order of carrying the good Gg is 500 pulses. A good takeout command is then issued to the takeout mechanism 7003 for the gravity roller conveyor 1*g*, instructing that after 8,100 pulses have been counted up since the start of arrangement, the good Gg should be discharged.

The good Gg is succeeded by a good Gr. The uppermost gravity roller conveyor 1*z* is separated from the gravity roller conveyor 1*r* by a distance (26−18)400 mm=3,200 mm. The position correction value for the good Gr is therefore 3,200 pulses. The correction value for the timing of carrying the good Gr depending on the order of carrying the good Gr is 1,000 pulses. A good takeout command is then issued to the takeout mechanism 7003 for the gravity roller conveyor 1*r*, instructing that after 4,200 pulses have been counted up since the start of arrangement, the good Gr should be discharged.

The good Gr is succeeded by a good Gr. The position correction value for the good Gr is 3,200 pulses. The correction value for the timing of carrying the good Gr depending on the order of carrying it is 1,500 pulses. A good takeout command is then issued to the takeout mechanism 7003 for the gravity roller conveyor 1*r*, instructing that after 4,700 pulses have been counted up since the start of arrangement, the good Gr should be discharged.

The good Gr is succeeded by a good Ga. The position correction value for the good Ga is 1,000 pulses. The correction value for the timing of carrying the good Ga depending on the order of carrying it is 2,000 pulses. A good takeout command is then issued to the takeout mechanism 7003 for the gravity roller conveyor 1*a*, instructing that after 12,000 pulses have been counted up since the start of arrangement, the good Gr should be discharged.

The good Ga is succeeded by a good Ge. The uppermost gravity roller conveyor 1*z* is separated from the gravity roller conveyor 1*e* by a distance (26−5)400 mm=8,400 mm. The position correction value for the good Ge is therefore 8,400 pulses. The correction value for the timing of carrying the good Ge depending on the order of carrying it is 2,500 pulses. A good takeout command is then issued to the takeout mechanism 7003 for the gravity roller conveyor 1*e*, instructing that after 10,900 pulses have been generated since the start of arrangement, the good Ge will be discharged.

The good Ge is succeeded by a good G1. The uppermost gravity roller conveyor 1*z* is separated from the gravity roller conveyor 11 by a distance (26−12)400 mm=5,600 mm. The position correction value for the good G1 is therefore 5,600 pulses. The correction value for the timing of carrying the good G1 depending on the order of carrying it is 3,000 pulses. A good takeout command is then issued to the takeout mechanism 7003 for the gravity roller conveyor 11, instructing that after 8,600 pulses have been counted up since the start of arrangement, the good G1 should be discharged.

The good G1 is succeeded by a good Gs. The uppermost gravity roller conveyor 1*z* is separated from the gravity roller conveyor 1*s* by a distance(26–19)400 mm=2,800 mm. The position correction value for the good Ge is therefore 2,800 pulses. The correction value for the timing of carrying the good Gs depending on the order of carrying it is 3,500 pulses. A good takeout command is then issued to the takeout mechanism 7003 for the gravity roller conveyor 1*s*, instructing that after 6,300 pulses have been counted up since the start of arrangement, the good Gs should be discharged.

Even when goods are discharged from the gravity roller conveyors 7001 on the second to fifth stories onto arrangement conveyors 7002, the position correction value and correction value depending on an order of carrying a good are computed similarly. Respective goods G are then discharged from the gravity roller conveyors 7001 to the arrangement conveyors 7002 according to specified timing.

An example of arranging intended goods G in one or two arrangement containers C has been described above. Needless to say, many goods G can be arranged continuously using arrangement containers C supplied continuously.

Figure 21:
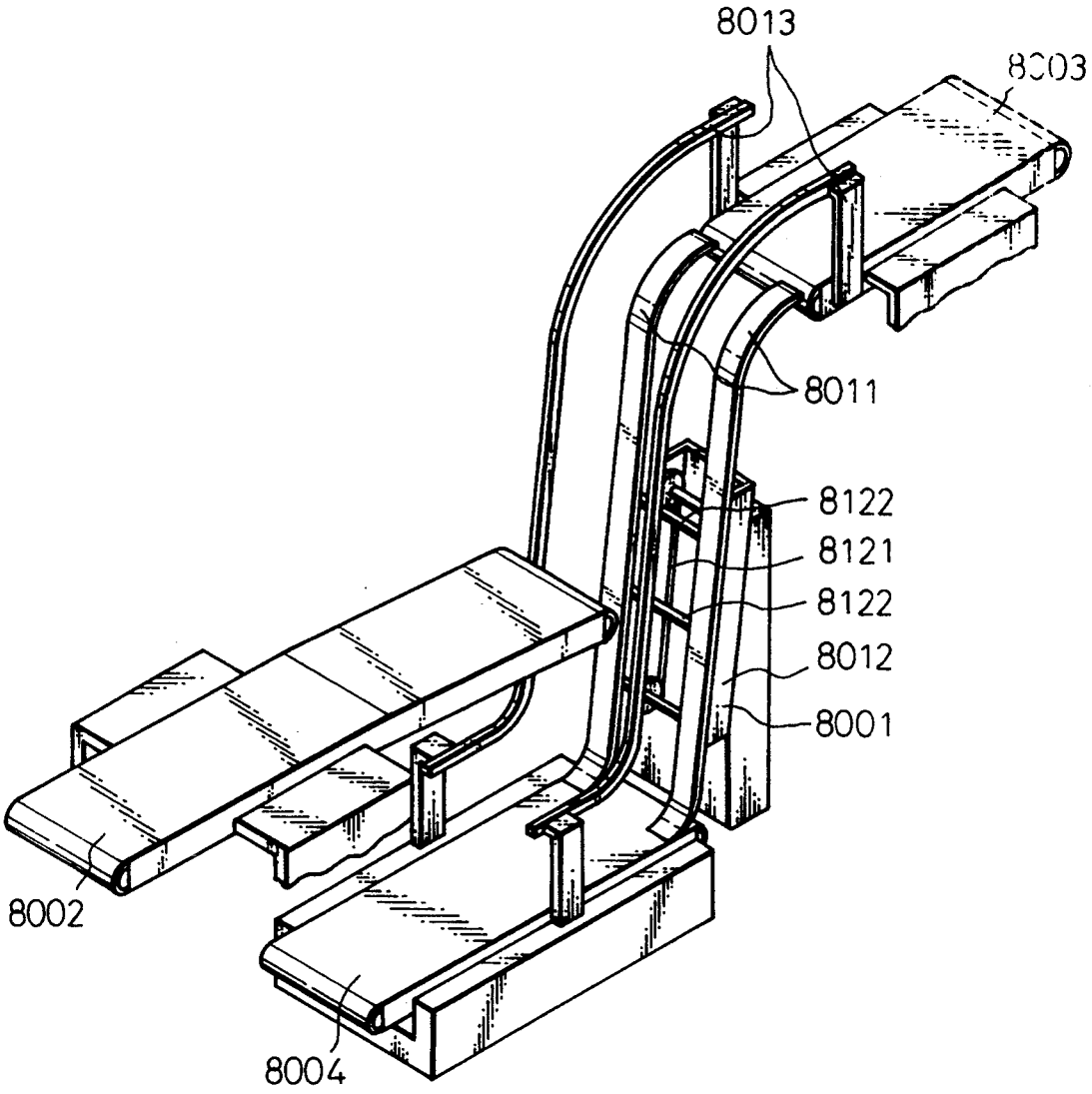
FIG. 21 is a partly enlarged oblique view showing a goods input apparatus in FIG. 1.

FIG. 21 shows a goods input apparatus 8000. FIGS. 22A to 22E are diagrams for explaining the actuation of the goods input apparatus 8000. The goods input apparatus 8000 comprises a goods feed conveyor 8002 linked in series with arrangement conveyors 7002, and a container carrier conveyor 8001 formed at an end of the goods feed conveyor 8002. The container carrier conveyor 8001 consists of a pair of container carrier chutes 8011 inclined and separated from each other, a positive-holding container carrier including a pair of endless belts 8121 placed between the pair of container carrier chutes 8011, and a pair of container restriction guides 8013 located above the pair of container carrier chutes 8011. Six claws 8122 are attached to the endless belts 8121. As shown in FIGS. 22, the claws 8122 lock arrangement containers C supplied over the container carrier chutes 8011. The endless belts 8121 are connected to a drive via a speed change gear (not shown) having an inverter. The endless belts 8121 are controlled to run at least two predetermined carrier speeds. A container carrying-in conveyor 8003 is located above the container carrier conveyor 8001. A container carrying-out conveyor 8004 is located downstream the container carrier belt conveyor 8001.

As shown in FIGS. 22A to 22E, the goods feed conveyor 8002 is a belt conveyor slightly inclined to put goods G in arrangement containers C with gravity in substantially parallel with a front wall C1 of each of the arrangement containers C carried in by the container carrier conveyor 8001. Goods G are arranged for each arrangement container C by the goods storage arrangement apparatus 7000, supplied at a specified speed by the arrangement conveyors 7002 and goods feed conveyor 8002, and then put in one of the arrangement containers C, which are moving with their faces down, so as to stack on the front wall C1 thereof. In this case, the speed at which the arrangement containers C move is substantially equal to the speed at which the goods G stack up. Each of the goods G is, for example, 300 mm long and 50 μm thick. The goods G are lined up in fives across the goods feed conveyor 8002 and carried continuously in certain pitches of 500 mm at intervals of, for example, 0.5 seconds.

Figure 22A:
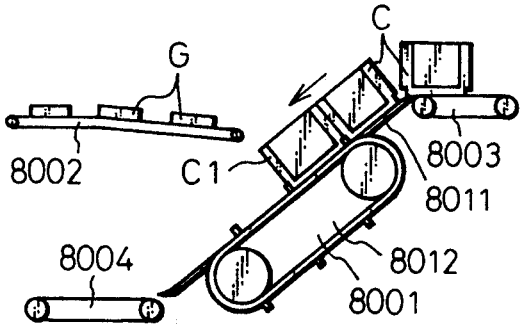
FIGS. 22A to 22E are explanatory diagrams for the operation of the goods input apparatus.
Figure 23:
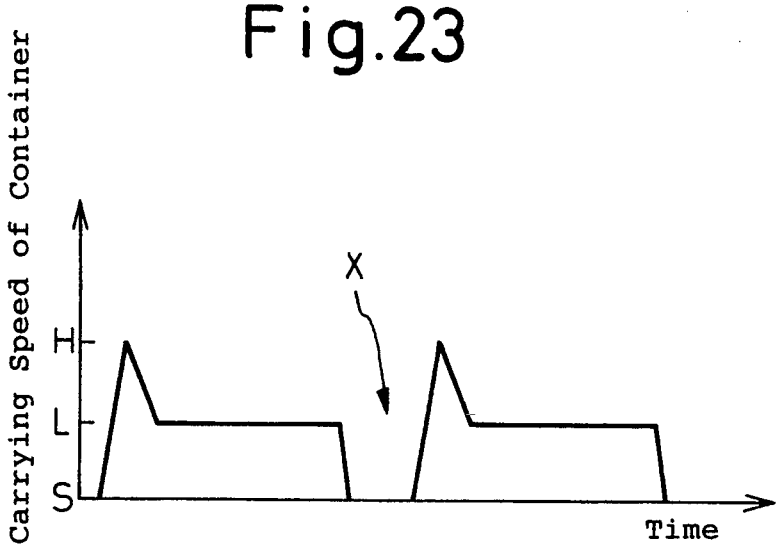
FIG. 23 shows an example of transition in the speed at which a positive-holding container carrier carries goods.

As shown in FIG. 22A, arrangement containers C are placed sequentially on the container carrier chutes 8011 by the container carrying-in conveyor 8003. After sliding on the container carrier chutes 8011, the arrangement containers C are locked by the claws 8122 of the positive-holding container carrier 8012. When one of the arrangement containers C is transported from the container carrying-in conveyor 8003 to the container carrier chutes 8011, a positive-holding container carrier 8012 is driven at a low speed. The arrangement container C transported onto the container carrier chutes 8011 is interlocked with an arrangement container C in which goods G are being put and carried at a low speed. Thereafter, the arrangement container C is stopped temporarily, carried at a high speed, carried at a low speed, stopped temporarily, and then carried at a high speed. The arrangement container C thus advances to a position at which goods G are put in. FIG. 23 shows this transition in the speed at which a container is carried. In FIG. 23, X denotes a period during which goods G are put into a container C.

When an arrangement container C reaches the position at which goods G are put, the speed at which the positive-holding container carrier 8012 carries a good changes from a high speed to a low speed. Goods G supplied by the goods feed conveyor 8002 drop in fives at a low speed into the arrangement container C moving at a low speed, and then stack and line up in the arrangement container C. In this embodiment, a speed at which goods G stack in an arrangement container C is calculated by dividing a thickness 50 mm by 0.5 seconds; that is, 6 mm/min. The speed at which an arrangement container C moves may equal to or slightly higher than the speed at which goods G stack, which ranges, for example, from 6 to 7 minutes.

Figure 22D:
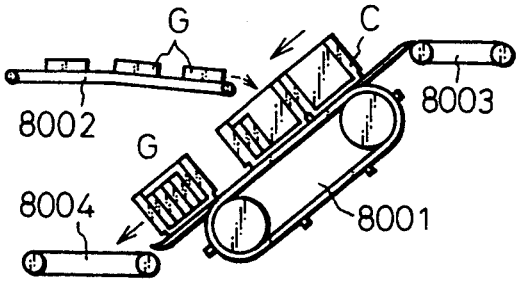
Figure 22B:
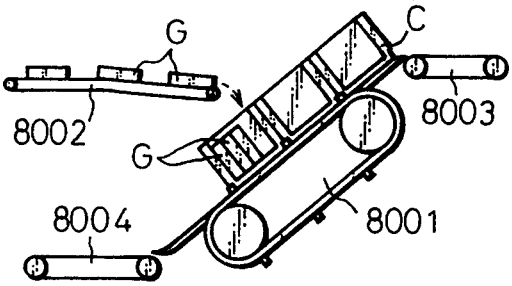
Figure 22E:
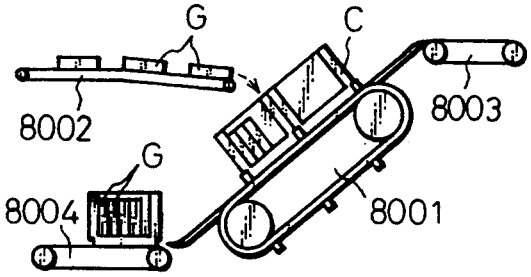

As shown in FIG. 22B, when the fourth row of goods G is put in an arrangement container C, the speed at which the positive-holding container carrier 8012 carries a good becomes zero. When the arrangement container C comes to a position at which the last fifth row of goods G are put therein, a detector (not shown) attached at a specified position detects the claw 8122 on the endless belts 8121. This causes the positive-holding container carrier 8012 to stop temporarily and stand by until the last fifth row of goods G have been put in the container. A time X in FIG. 23 denotes the standby period.

Figure 22C:
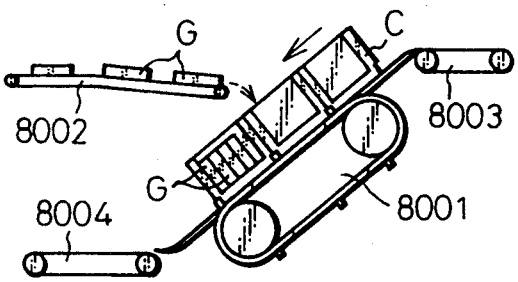

When the last fifth row of goods G have been put in the arrangement container C, as shown in FIG. 22C, the positive-holding container carrier 8012 is driven at a high speed. The arrangement container C is then carried to a position at which succeeding rows of goods G, which are carried in certain pitches continuously, can be put slightly above the front wall C1 of the succeeding arrangement container C. The positive-holding container carrier 8012 changes its speed from a high speed to a low speed. A procedure similar to the aforesaid one is performed to put the goods G in the succeeding arrangement container C. The aforesaid transition in speed allows the first row of goods G, which is to be put in a succeeding arrangement container C, to enter the succeeding arrangement container C without hitting the back wall of the preceding arrangement container C or the front wall C1 of the succeeding arrangement container C.

As shown in FIG. 22D, an arrangement container C in which goods G have been put is released from the positive-holding container carrier 8012. The arrangement container C then slides on the container carrier chutes 8011, which is then fed to the next process by the container carrier conveyor 8004. When the arrangement container C changes from an inclined state to a horizontal state, the twenty pieces of goods G contained in the arrangement container C change in a horizontal state change to an upright state.

Embodiments of a goods arrangement method and system according to the present invention have been described so far. A goods arrangement system of the present invention is not limited to the embodiment. For example, goods of a certain item may be stored in a single gravity roller conveyor 7001. Alternatively, goods of the same item may be stored in multiple gravity roller conveyors 7001 that are lined up along a single arrangement conveyor 7002, and then fed to the arrangement conveyor 7002 simultaneously for arrangement.

The length of a good may differ from item to item. In this case, a virtual space may be set depending on the order of carrying a good or the size of a good; that is, a virtual space calculated by adding a certain tolerance such as 200 mm to the length of a good may be set continuously on an arrangement conveyor 7002. When a specified virtual space has come to a position at which a good to be arranged faces the arrangement conveyor 7002, the good may be discharged to the arrangement conveyor 7002.

Fifty goods contained in a box may not be stored in tens in a gravity roller conveyor 7001. Alternatively, all goods stored in the first box may be stored in the gravity roller conveyor 7001 on the lowest story, all goods stored in the second box may be stored in the gravity roller conveyors 7001 on the second lowest story, and so on. Goods may thus be stored on a gravity roller conveyor 7001 box by box.

When three or more gravity roller conveyors 7001 store goods of the same item, the goods of the same item stored in at least two gravity roller conveyors 7001 are fed to an arrangement conveyor 7002 substantially simultaneously, and then arranged.

The pusher plate 5004 of the goods takeout apparatus 5000 may be replaced with a sucker to pull out a good. The swing conveyor 6031 of the goods feeder 6000 may be replaced with a vertical conveyor. The gradient storage shelf 7004 of the goods storage arrangement apparatus 7000 may not be used but goods may be stored on a driving conveyor.

The number of goods to be put in an arrangement container is not limited to twenty but may differ among arrangement containers.

As described so far, according to the present invention, goods can be discharged to multiple arrangement conveyors simultaneously, and the row of goods can be put in an arrangement container simultaneously. The present invention permits the handling of goods at a considerably higher speed than a prior art in which goods are handled in a row. Furthermore, a goods arrangement system according to the present invention can include relevant equipment employed before and after the goods storage arrangement apparatus, thus configuring a more efficient system.

The present invention is effective, in particular, for taking out and arranging a required number of required products from among paper-made containers each containing multiple packs of cigarettes, which are encased in cases or wrapped in paper, or packed foods.

We claim:

1. A goods arrangement system, comprising:

a goods takeout apparatus for taking out a plurality of goods from a container;

a goods storage arrangement apparatus capable of storing the taken-out goods temporarily and discharging a specified number of the goods simultaneously, said goods storage arrangement apparatus including a gradient storage shelf having at least one inlet and at least one outlet;

a goods feeder for feeding the goods taken out by said goods takeout apparatus to the inlet of said gradient storage shelf;

a goods input apparatus for putting the goods, which have been arranged and discharged by said goods storage arrangement apparatus, in an arrangement container; and at least one arrangement conveyor located between said outlet of said gradient storage shelf and said goods input apparatus.

2. The goods arrangement system of claim 1, comprising a plurality of arrangement conveyors located between said outlet of said gradient storage shelf and said goods input apparatus.

3. The goods arrangement system of claim 2, wherein said gradient storage shelf includes a plurality of gravity roller conveyors inclined unidirectionally; each of said gravity roller conveyors having an inlet located at a higher position and an outlet located at a lower position; and a takeout mechanism for taking out one of said goods located at each of said outlets.

4. The goods arrangement system of claim 3, wherein said gravity roller conveyors are arranged in the form of a matrix of a plurality of stories and columns; the number of arrangement conveyors being the same as the number of stories in which said gravity roller conveyors are arranged; and each of said arrangement conveyors being linked with said gravity roller conveyors on all columns on each story.

5. The goods arrangement system of claim 3, wherein said takeout mechanism for taking out one of said goods at an outlet of each of said gravity roller conveyors includes a stopper having a substantially U-shaped cross section; said stopper having a front arm oriented to said arrangement conveyor and a back arm oriented to said inlet; and said stopper assuming either a first state in which said front arm projects into a path of said goods or a second state in which said back arm projects into the path of said goods.

6. A goods arrangement system, comprising:

a goods takeout apparatus for taking out a plurality of goods from a box having inner flaps and outer flaps;

an unpacking device for peeling off the outer flaps from the inner flaps of a box located upstream of said goods takeout apparatus;

a goods storage arrangement apparatus capable of storing the taken-out goods temporarily and discharging a specified number of the goods simultaneously;

a goods feeder for feeding the goods taken out by said goods takeout apparatus to said goods storage arrangement apparatus; and a goods input apparatus for putting the goods, which have been arranged and discharged by said goods storage arrangement apparatus, in an arrangement container.

7. The goods arrangement system of claim 6, wherein said outer flaps include an upper outer flap and a lower outer flap; a flap opening device being located between said goods takeout apparatus and said unpacking device to open said upper outer flap upward of said box and said lower outer flap downward thereof.

8. The goods arrangement system of claim 7, wherein a pusher for changing the orientation of said box is placed between said flap opening device and said goods takeout apparatus; said pusher pushing said opened upper outer flap of said box and said opened lower outer flap thereof; said pusher including a pusher plate and a sucking device that is attached to a side of said pusher plate.

9. The goods arrangement system of claim 8, wherein said goods takeout apparatus includes a pusher that is inserted into said box from a side from which said upper outer flap and said lower outer flap have been opened; said pusher having a circular front surface.

10. A goods arrangement system, comprising:

a goods takeout apparatus for taking out a plurality of goods from a container;

a goods storage arrangement apparatus capable of storing the taken-out goods temporarily and discharging a specified number of the goods simultaneously;

a goods feeder for feeding the goods taken out by said goods takeout apparatus to said goods storage arrangement apparatus; said goods feeder including a running unit that is movable along in front of a plurality of lined up inlets of said goods storage arrangement apparatus; said running unit having a warehousing device for feeding goods to said inlets of said goods storage arrangement apparatus.

11. The goods arrangement system of claim 10, wherein said running unit is a running cart and said warehousing device is mounted on said running cart so as to ascend or descend.

12. The goods arrangement system of claim 10, wherein said running unit is a running cart; a swing conveyor is mounted on said running cart to carry the goods in parallel with the direction in which said running cart runs; and said warehousing device feeds the goods perpendicular to the direction in which said running cart runs.

13. The goods arrangement system of claim 12, wherein said warehousing device is mounted on said running cart so as to ascend or descend.

14. The goods arrangement system of claim 12, wherein a carrier conveyor for carrying the goods taken out by said goods takeout apparatus adjoins said running cart; and a goods take-in device for transporting goods from said carrier conveyor to said swing conveyor is mounted on said running cart.

* * * * *

UNITED STATES PATENT AND TRADEMARK OFFICE

CERTIFICATE OF CORRECTION

PATENT NO. : 5,386,677

DATED : February 7, 1995

INVENTOR(S) : Manabu Kobuki et al.

It is certified that error appears in the above-indentified patent and that said Letters Patent is hereby corrected as shown below:

On the title page: Item [73]
the second-named assignee -- "Japan Tabacco Inc." -- should read -- Japan Tobacco Inc.--.

Signed and Sealed this

Nineteenth Day of December, 1995

*Attest:*

*Attesting Officer*

BRUCE LEHMAN

*Commissioner of Patents and Trademarks*